US007341813B2

(12) United States Patent
Shigezaki et al.

(10) Patent No.: US 7,341,813 B2
(45) Date of Patent: Mar. 11, 2008

(54) ELECTROPHOTOGRAPHIC PHOTORECEPTOR, ELECTROPHOTOGRAPHIC MEMBER, PROCESS CARTRIDGE AND IMAGE FORMING APPARATUS

(75) Inventors: Satoshi Shigezaki, Miniamiashigara (JP); Hiroe Okuyama, Minamiashigara (JP); Takahiro Suzuki, Minamiashigara (JP); Katsumi Nukada, Minamiashigara (JP); Eiji Funabashi, Sagamihara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 83 days.

(21) Appl. No.: 10/857,960

(22) Filed: Jun. 2, 2004
(Under 37 CFR 1.47)

(65) Prior Publication Data

US 2004/0224245 A1 Nov. 11, 2004

Related U.S. Application Data

(63) Continuation of application No. 10/445,853, filed on May 28, 2003, now abandoned.

(30) Foreign Application Priority Data

Jun. 26, 2002 (JP) ..... 2002-185935
Feb. 27, 2003 (JP) ..... 2003-50886

(51) Int. Cl.
*G03G 5/147* (2006.01)

(52) U.S. Cl. ..... 430/66; 430/132; 399/159

(58) Field of Classification Search ..... 430/66, 430/132, 67; 399/159, 147
See application file for complete search history.

(56) References Cited

U.S. PATENT DOCUMENTS

| | | | | |
|---|---|---|---|---|
| 4,114,536 | A | 9/1978 | Kaneko et al. | |
| 4,522,866 | A | 6/1985 | Nishikawa et al. | |
| 4,734,347 | A | 3/1988 | Endo et al. | |
| 4,956,211 | A | 9/1990 | Saito | |
| 5,106,682 | A * | 4/1992 | Matsushita et al. | 428/324 |
| 5,107,303 | A | 4/1992 | Miyamoto et al. | |
| 5,172,173 | A | 12/1992 | Goto et al. | |

(Continued)

FOREIGN PATENT DOCUMENTS

EP 0 606 074 A1 7/1994

(Continued)

OTHER PUBLICATIONS

Chinese Office Action and English translation of Chinese Office Action, Dec. 8, 2006.

(Continued)

*Primary Examiner*—John L. Goodrow
(74) *Attorney, Agent, or Firm*—Oliff & Berridge, PLC

(57) ABSTRACT

The present invention provides an electrophotographic photoreceptor and an electrophotographic member, which have superior mold releasing and sliding properties and are able to maintain these properties over long periods of time, the photoreceptor comprising a first layer and a second layer, which includes a fluororesin layer, externally disposed on the first layer to form an outermost layer, the electrophotographic member comprising a first layer and a second layer, which includes a fluororesin layer, externally disposed on the first layer to form an outermost layer and filling voids in the first layer, and further provides a process cartridge equipped with said electrophotographic photoreceptor or said electrophotographic member, and an image forming apparatus.

39 Claims, 2 Drawing Sheets

U.S. PATENT DOCUMENTS

| | | | | |
|---|---|---|---|---|
| 5,242,774 | A * | 9/1993 | Odell et al. | 430/58.8 |
| 5,303,014 | A | 4/1994 | Yu et al. | |
| 5,412,454 | A | 5/1995 | Asanae | |
| 5,418,605 | A | 5/1995 | Arahira et al. | |
| 5,626,998 | A * | 5/1997 | Grabowski et al. | 430/67 |
| 5,666,606 | A * | 9/1997 | Okano et al. | 399/174 |
| 5,667,926 | A * | 9/1997 | Maruyama et al. | 430/97 |
| 5,674,671 | A * | 10/1997 | Brandon et al. | 430/527 |
| 5,885,698 | A * | 3/1999 | Takehana et al. | 428/212 |
| 5,905,008 | A * | 5/1999 | Yoshinaga et al. | 430/58.2 |
| 5,930,573 | A | 7/1999 | Miyamoto et al. | |
| 6,219,510 | B1 | 4/2001 | Ando et al. | |
| 6,327,454 | B1 * | 12/2001 | Yuan et al. | 399/303 |
| 6,400,919 | B1 | 6/2002 | Inoue et al. | |
| 6,477,344 | B1 | 11/2002 | Asakura et al. | |
| 6,560,427 | B2 * | 5/2003 | Kubo et al. | 399/159 |
| 6,664,014 | B1 * | 12/2003 | Kikuchi et al. | 430/66 |
| 7,074,540 | B2 * | 7/2006 | Nukada et al. | 430/125 |
| 2002/0068231 | A1 * | 6/2002 | Useugi | 430/66 |

FOREIGN PATENT DOCUMENTS

| | | | |
|---|---|---|---|
| EP | 0 691 594 | A1 | 1/1996 |
| EP | 0 747 780 | A2 | 12/1996 |
| EP | 0 805 170 | A2 | 11/1997 |
| EP | 0 939 348 | A2 | 9/1999 |
| EP | 1 058 164 | A2 | 12/2000 |
| EP | 1 089 132 | A2 | 4/2001 |
| EP | 1 172 702 | A1 | 1/2002 |
| JP | A 61-193157 | | 8/1986 |
| JP | A 63-56658 | | 3/1988 |
| JP | A 63-65450 | | 3/1988 |
| JP | 64/001762 | | 1/1989 |
| JP | 64-001762 | | 1/1989 |
| JP | 1-279282 | | 11/1989 |
| JP | A 2-101488 | | 4/1990 |
| JP | A 2-107983 | | 4/1990 |
| JP | A 2-245767 | | 10/1990 |
| JP | A 3-269564 | | 12/1991 |
| JP | A 4-93973 | | 3/1992 |
| JP | A 05-333733 | | 12/1993 |
| JP | A-06-095415 | | 4/1994 |
| JP | A 09-026670 | | 1/1997 |
| JP | A-10-031371 | | 2/1998 |
| JP | A 63-279828 | | 2/1998 |
| JP | A-10-213974 | | 8/1998 |
| JP | A-11-052755 | | 2/1999 |
| JP | A-2000-108223 | | 4/2000 |
| JP | A-2000-304101 | | 11/2000 |
| JP | A 2001-189226 | | 7/2001 |
| JP | A 2002-23514 | | 1/2002 |
| JP | A 2002-278122 | | 9/2002 |
| JP | A 2003-316056 | | 11/2003 |
| WO | WO 00/40345 | | 7/2000 |
| WO | WO-00/40345 | | 7/2000 |
| WO | WO 01/36831 | A1 | 5/2001 |

OTHER PUBLICATIONS

English-language translation of Japanese Office Action, dated Oct. 2, 2007.

* cited by examiner

ELECTROPHOTOGRAPHIC PHOTORECEPTOR, ELECTROPHOTOGRAPHIC MEMBER, PROCESS CARTRIDGE AND IMAGE FORMING APPARATUS

This is a Continuation of application Ser. No. 10/445,853 filed May 28, 2003 now abandoned. The entire disclosure of the prior application is hereby incorporated by reference herein in its entirety.

BACKGROUND OF THE INVENTION

1. Field of the Invention

The present invention relates to an electrophotographic photoreceptor, an electrophotographic member, a process cartridge and an image forming apparatus that are applicable to an electrophotographic apparatus using an electrophotographic process, such as a copying machine, a printer and a facsimile.

2. Description of the Related Art

In a typical electrophotographic process, after the surface of an electrophotographic photoreceptor formed by utilizing a photo-conductive substance (hereinafter, sometimes referred to simply as the "photoreceptor") has been evenly charged, a latent image is formed through exposure, and the latent image thus formed is developed by using toner to form a toner image, and after the toner image on the surface of the photoreceptor has been transferred onto the surface of a transferring material such as paper by using an intermediate transferring member or without using this, the transferred image is heated, pressed or heated while being pressed, or subjected to solvent vapor and the like so as to be fixed; thus, a fixed image is formed after having been subjected to these processes. Residual toner on the surface of the photoreceptor is cleaned by cleaning member, if necessary, and again supplied to the above-mentioned processes.

With respect to the surface of the above-mentioned electrophotographic photoreceptor, various characteristics, such as chemical resistance against ozone and NOx generated at the time of charging and a mold-releasing property for improving transferring efficiency, as well as a surface-sliding property, an anti-abrasion property and hardness with respect to mechanical cleaning processes, are required. For this reason, conventionally, a method has been proposed in which a resin layer, formed by dispersing fluorine resin particles such as polytetrafluoroethylene (PTFE), is placed on the surface of a photoreceptor as a surface protective layer (for example, refer to Japanese Patent Application Laid-Open (JP-A) No. 63-56658 and JP-A No. 63-65450). Such a resin layer makes it possible to reduce the frictional coefficient on the surface of the resin layer, to improve the cleaning property, and also to improve the endurance against abrasion. Moreover, it becomes possible to shield a charge-transporting layer and a charge-generating layer that are susceptible to degradation by ozone from outside air, and consequently to improve chemical endurance.

However, since the fluororesin particles used in the fore-mentioned resin layer are not sufficient in the water repellent property thereof, and since the binder resin is exposed on the surface of the resin layer, it is not possible to express a sufficient mold-releasing property. Moreover, a method which polishes the resin layer having the dispersed fluororesin particles so that more portions of the fluororesin particles are exposed has also been proposed; however, the resulting effects are not so great in comparison with its increased costs. Furthermore, in some cases, it is only possible to obtain a contact angle that is equivalent to the application of a single binder resin in the case of the range of the fluororesin content that is practically applicable.

Moreover, in an attempt to increase the fluororesin particles so as to increase the mold-releasing property, fogging is generated on the surface of the photoreceptor to cause degradation in the sensitivity therefore as a result, it causes the degradation in the image quality. In the case of an electrophotographic photoreceptor, the smaller the contact angle, the greater the subsequent surface free energy; consequently, the following problems tend to occur: degradation in the mold-releasing property and the subsequent increase in residual toner from transferring processes (degradation in the transferring efficiency), an increase in surface contamination due to NOx and the like, degradation in the cleaning property due to degradation in the surface sliding property and re-adherence of toner to the surface of the photoreceptor.

Here, the cleaning member as the electrophotographic photoreceptor is used for removing residual toner on the surface of the photoreceptor. The residual toner on the surface of the photoreceptor has a charge, and is allowed to adhere to the surface of the photoreceptor by a strong electrostatic attracting force; therefore, in order to overcome such an electrostatic attracting force to remove the toner from the surface of the photoreceptor, it is necessary to press a blade-shaped cleaning member onto the surface of the photoreceptor with a great pressure.

Since this blade-shaped cleaning member (cleaning blade) requires properties such as superior chemical resistance, anti-abrasion property, moldability and mechanical strength, urethane rubber which is provided with such properties has come to be widely used. However, since a cleaning blade made from urethane rubber has a great coefficient of friction against a photoreceptor whose surface layer is made from a polymer resin such as polycarbonate, a great frictional force is exerted between the photoreceptor and the cleaning blade so that the cleaning blade tends to reversely rotate along the rotation direction of the photoreceptor (blade peeling), resulting in a failure in driving the photoreceptor, as well as making the cleaning process inoperable.

For this reason, fluororesin fine powder or the like having a lubricating property is applied to, or dipped onto an edge portion of the cleaning blade to form a lubricating layer to reduce the coefficient of friction so as to solve the above-mentioned problems. However, this method in which the lubricating layer is formed by using the fluororesin fine powder requires a lubricating layer forming process in addition to a normal cleaning-blade manufacturing process, resulting in complex working processes.

Here, a cleaning blade, which has an edge portion on which a low friction layer mainly composed of rubber and resin is formed, has been proposed (for example, refer to JP-A Nos. 63-27928, 2-101488 and 2-107983). This cleaning blade is formed by applying a low-friction-layer forming material prepared by mixing materials such as silicone powder, fluororesin powder and polymethyl methacrylate (PMMA) powder into a binder such as urethane rubber, silicone rubber, silicone resin, fluororubber, fluororesin and nylon onto a photoreceptor contact portion (edge portion) of the cleaning blade through a dipping method or the like, thereby providing a low friction layer thereon. With this arrangement, it becomes possible to reduce friction between the photoreceptor and the cleaning blade, and consequently to prevent the cleaning blade from being reversed even in a state in which no toner exists on the surface of the photoreceptor, such as a copying process starting state. However, the cleaning blade on which the above-mentioned low-friction layer is formed tends to cause an insufficient reverse-preventing operation in the case where the above-mentioned binder is made from rubber, and also tends to damage the surface of the photoreceptor in the case where the binder is made from resin.

Moreover, many methods have been proposed in which powder or a liquid-state lubricant is added to urethane rubber that is a material forming the cleaning blade so as to improve the lubricating property (for example, refer to JP-A Nos. 1-279282, 3-269564 and 4-93973). However, for example, the cleaning blade which is made of urethane rubber obtained by adding a powder-form lubricant becomes hard, and tends to damage the photoreceptor. Moreover, the application of the cleaning blade made of urethane rubber obtained by adding the liquid-state lubricant tends to cause another problem in which the liquid-state lubricant exudes on the surface of a cleaning blade and contaminates the photoreceptor. As described above, at present, an effective method for preventing the cleaning blade from reversing at the initial state upon starting a copying operation has not been obtained yet. Moreover, in order to improve the endurance of the cleaning blade, a method in which a plasma polymerization film is used has been proposed; however, since the cleaning blade obtained in this method has a plasma polymerization film that is formed on only one surface including an edge portion, it is not possible to prevent the cleaning blade from being reversed.

Moreover, in the case where the intermediate transferring member, which is abutted on the photoreceptor, and allows a toner image on the surface of the photoreceptor to be transferred thereon, has a low mold-releasing property on its surface, "an image loss phenomenon" tends occur during the transferring process. The following items are listed as reasons for the occurrence of this "image loss phenomenon".

The toner layer becomes thicker in the full-color image forming apparatus.

The application of a roller-shaped transferring member causes a high contact pressure, resulting in a strong mechanical adhesive force between the surface of the intermediate transfer member and the toner.

Since the image-forming processes are executed repeatedly, a so-called filming phenomenon in which toner adheres to the intermediate transferring member in a film shape tends to occur to generate a strong adhesive force between the surface of the intermediate transferring member and the toner.

With respect to means for avoiding "the image loss phenomenon" caused by the above-mentioned reasons, the following methods have been proposed (for example, refer to JP-A No. 2002-23514).

(1) A roller (conditioning means), which is formed by a member made from a silicone-based material having surface energy that is smaller than the surface energy of the intermediate transferring member, is abutted on the surface of the intermediate transferring member so that a conditioning process for reducing the surface energy of the surface of the intermediate transferring member is provided. In this method, by adding a substance for reducing the surface energy to the intermediate transferring member, the surface energy of the intermediate transferring member is reduced.

(2) Linear velocities of the intermediate transferring member and the transferring member on which toner on the surface of the intermediate transferring member is transferred are made different from each other; thus, in this method, "the image loss phenomenon" at the time of the transferring process is reduced.

(3) A method in which zinc stearate is applied to the intermediate transferring member as a lubricant.

As described above, in the intermediate transferring member also, there have been demands for a high mold-releasing property and a sliding property, and various methods have been proposed to achieve these properties; however, these methods have not provided sufficient solutions that achieve desirable mold-releasing property and sliding property, and maintain the high mold-releasing property and sliding property for a long time.

Furthermore, in each of the members, such as the charging member which is abutted on the surface of the photoreceptor, or is placed close to the surface thereof so as to charge the surface of the photoreceptor, the transferring member for transferring the toner image of the surface of the photoreceptor to a transferring material, the transferring member for transferring the toner image of the surface of the intermediate transferring member to a transferring material and the conveying member for conveying the transferring material, the following problems are raised when the mold-releasing property is low on the surface thereof.

In the case where the surface mold-releasing property of the charging member which is abutted on the surface of the photoreceptor or is placed close thereto so as to charge the surface of the photoreceptor is low, residual toner and external additives and further paper powder and the like tend to adhere as time has elapsed and it is difficult to remove these; therefore, it becomes difficult to evenly maintain the charging state on the surface of the photoreceptor, resulting in a defective image due to an insufficient charging process.

In the case where the surface mold-releasing property of the transferring member for transferring the toner image of the surface of the photoreceptor to a transferring material and the transferring member for transferring the toner image of the surface of the intermediate transferring member to a transferring material is low, the toner and external additives and further paper powder and the like tend to adhere thereto as time has elapsed, and are hardly removed; therefore, it is not possible to form a sufficient transferring electric field, resulting in a defective image due to a defective transferring process. Further, this phenomenon is particularly conspicuous in the case of the transferring member for transferring the toner image of the surface of the intermediate transferring member to a transferring material.

In the case where the surface mold-releasing property of the conveying member for transporting a transferring material is low, toner powder, paper powder and the like floating inside the machine tend to adhere thereto as time has elapsed, and it is difficult to remove these; therefore, stains on the surface of the conveying member are always transferred onto the transferring material.

As described above, with respect to the electrophotographic members, in the case where the mold-releasing property and the sliding property on the surface are low, various problems are raised; therefore, there have been strong demands for a member which has high mold-releasing property and sliding property on its surface, and also maintains the mold-releasing property and sliding property for a long time.

SUMMARY OF THE INVENTION

The present invention has been devised to solve the above-mentioned conventional problems and also to achieve the following objects. In other words, the object of the invention is to provide an electrophotographic photoreceptor and an electrophotographic member which have superior mold-releasing property and sliding property, and also maintains the superior mold-releasing property and sliding property for a long time. Moreover, another object of the invention is to provide a process cartridge and an image forming apparatus which are provided with the above-mentioned electrophotographic photoreceptor and electrophotographic member so that it becomes possible to reduce environmental loads, and also to reduce costs to a great degree.

The inventors of the invention have found the structure of an electrophotographic photoreceptor and an electrophotographic member which can completely solve the problems which the above-mentioned electrophotographic photoreceptor and an electrophotographic member have, and have achieved the invention.

The above-mentioned objects are achieved by the following aspects of the invention:

According to a first aspect of the invention, there is provided an electrophotographic photoreceptor comprising at least:

a first layer; and a second layer containing at least one kind of fluororesin and externally disposed on the first layer to be an outermost layer.

According to a second aspect of the invention, there is provided an electrophotographic photoreceptor, wherein the second layer fills voids in the surface of the first layer.

According to a third aspect of the invention, there is provided an electrophotographic photoreceptor, wherein the coefficient of dynamic friction of the surface of the second layer is 0.5 or less.

According to a fourth aspect of the invention, there is provided an electrophotographic photoreceptor, wherein the first layer is formed as a layer having a charge-generating function and a charge transferring function.

According to a fifth aspect of the invention, there is provided an electrophotographic photoreceptor, wherein the first layer is constituted by two layers, that is, a charge-generating layer having a charge-generating function and a charge-transporting layer having a charge-transporting function.

According to another aspect of the invention, there is provided an electrophotographic photoreceptor, wherein the second layer contains at least one of a homopolymer and a copolymer of tetrafluoroethylene.

According to another aspect of the invention, there is provided an electrophotographic photoreceptor, wherein the first layer includes a layer containing a thermoplastic resin.

According to another aspect of the invention, there is provided an electrophotographic photoreceptor, wherein the first layer includes a layer containing a curable resin.

According to another aspect of the invention, there is provided an electrophotographic photoreceptor, wherein the first layer includes a layer containing Si atom.

According to another aspect of the invention, there is provided an electrophotographic photoreceptor, wherein the second layer is formed by an impregnating process in which a treatment solution containing at least one of a homopolymer and a copolymer of tetrafluoroethylene is used.

According to another aspect of the invention, there is provided an electrophotographic photoreceptor, wherein the second layer is formed by an application-impregnating process in which a treatment solution containing at least one of a homopolymer and a copolymer of tetrafluoroethylene is applied to the outer circumferential face of the first layer, and the coated face is left for a predetermined time.

According to another aspect of the invention, there is provided an electrophotographic photoreceptor, wherein the second layer is formed by a heat-impregnating process in which a treatment solution containing at least one of a homopolymer and a copolymer of tetrafluoroethylene is applied to the outer circumferential face of the first layer at a temperature higher than normal temperature.

According to another aspect of the invention, there is provided an electrophotographic photoreceptor, wherein the second layer is formed by a vacuum-impregnating process in which a treatment solution containing at least one of a homopolymer and a copolymer of tetrafluoroethylene is applied to the outer circumferential face of the first layer and the coated face is subjected to a reduced-pressure process and a normal-pressure process repeatedly at a temperature of not less than normal temperature.

According to another aspect of the invention, there is provided an electrophotographic photoreceptor, wherein the second layer is formed by a pressure-impregnating process in which a treatment solution containing at least one of a homopolymer and a copolymer of tetrafluoroethylene is applied to the outer circumferential face of the first layer and the coated face is subjected to a pressure-applying process and a normal-pressure process repeatedly at a temperature of not lower than normal temperature.

According to another aspect of the invention, there is provided an electrophotographic member comprising at least: a third layer; and a fourth layer containing at least one kind of fluororesin and externally disposed on the third layer to form an outermost layer.

According to another aspect of the invention, there is provided an electrophotographic member, wherein the fourth layer fills voids in the surface of the third layer.

According to another aspect of the invention, there is provided an electrophotographic member, wherein the fourth layer contains at least one of a homopolymer and a copolymer of tetrafluoroethylene.

According to another aspect of the invention, there is provided an electrophotographic member, wherein the third layer includes a layer containing a thermoplastic resin.

According to another aspect of the invention, there is provided an electrophotographic member, wherein the third layer includes a layer containing a curable resin.

According to another aspect of the invention, there is provided an electrophotographic member, wherein the fourth layer is formed by an impregnating process in which a treatment solution containing at leas one of a homopolymer and a copolymer of tetrafluoroethylene is used.

According to another aspect of the invention, there is provided an electrophotographic member, wherein the fourth layer is formed by an application-impregnating process in which a treatment solution containing at least one of a homopolymer and a copolymer of tetrafluoroethylene is applied to the outer circumferential face of the third layer and the coated face is left for a predetermined time.

According to another aspect of the invention, there is provided an electrophotographic member, wherein the fourth layer is formed by a heat-impregnating process in which a treatment solution containing at least one of a homopolymer and a copolymer of tetrafluoroethylene is applied to the outer circumferential face of the third layer at a temperature higher than normal temperature.

According to another aspect of the invention, there is provided an electrophotographic member, wherein the fourth layer is formed by a vacuum-impregnating process in which a treatment solution containing at least one of a homopolymer and a copolymer of tetrafluoroethylene is applied to the outer circumferential face of the third layer and the coated face is subjected to a reduced-pressure process and a normal-pressure process repeatedly at a temperature of not less than normal temperature.

According to another aspect of the invention, there is provided an electrophotographic member, wherein the fourth layer is formed by a pressure-impregnating process in which a treatment solution containing at least one of a homopolymer and a copolymer of tetrafluoroethylene is applied to the outer circumferential face of the third layer and the coated face is subjected to a pressure-applying process and a normal-pressure process repeatedly at a temperature of not lower than normal temperature.

According to another aspect of the invention, there is provided an electrophotographic member, wherein the electrophotographic member serves as cleaning member which is abutted by an electrophotographic photoreceptor, and removes residual toner on the surface of the electrophotographic photoreceptor.

According to another aspect of the invention, there is provided an electrophotographic member, wherein the surface of the cleaning member has a coefficient of dynamic friction of not more than 1.0.

According to another aspect of the invention, there is provided an electrophotographic member, wherein the electrophotographic member serves as a charging member, which is abutted by an electrophotographic sensitive member, and charges the surface of the electrophotographic photoreceptor.

According to another aspect of the invention, there is provided an electrophotographic member, wherein the electrophotographic member serves as a transferring member, which is abutted by an electrophotographic sensitive member through a transferring material, and transfers a toner image on the surface of the electrophotographic sensitive member to the transferring material.

According to another aspect of the invention, there is provided an electrophotographic member, wherein the electrophotographic member serves as an intermediate transferring member, which is abutted by an electrophotographic photoreceptor, and allows a toner image on the surface of the electrophotographic photoreceptor to be transferred thereon.

According to another aspect of the invention, there is provided an electrophotographic member, wherein the electrophotographic member serves as a transferring member, which is abutted by an intermediate transferring member, and allows a toner image on an electrophotographic photoreceptor to be transferred onto the intermediate transferring member.

According to another aspect of the invention, there is provided an electrophotographic member, wherein the electrophotographic member serves as a transferring member, which is abutted by an intermediate transferring member through a transferring material, and allows a toner image on the surface of the intermediate transferring member to be transferred onto the transferring material.

According to another aspect of the invention, there is provided an electrophotographic member, wherein the electrophotographic member serves as a conveying member which transports a transferring material.

According to another aspect of the invention, there is provided a process cartridge detachably attached to an image forming apparatus, wherein the image forming apparatus includes an electrophotographic photoreceptor including at least a first layer and a second layer containing at least one kind of fluororesin and externally disposed on the first layer and an electrophotographic member including at least a third layer and a fourth layer containing at least one kind of fluororesin, externally disposed on the third layer, and filling voids in the surface of the third layer, and the image forming apparatus includes at least one of a cleaning member and a charging member.

According to another aspect of the invention, there is provided an image forming apparatus detachably attached to a process cartridge, the image forming apparatus comprising:

an electrophotographic photoreceptor including at least a first layer and a second layer containing at least one kind of fluororesin and externally disposed on the first layer;

an electrophotographic member including at least a third layer and a fourth layer containing at least one kind of fluororesin, externally disposed on the third layer, and filling voids in the surface of the third layer, and at least one of a cleaning member and a charging member.

According to another aspect of the invention, there is provided an image forming apparatus comprising:

an electrophotographic photoreceptor including at least a first layer and a second layer containing at least one kind of fluororesin and externally disposed on the first layer;

an electrophotographic member including at least a third layer and a fourth layer containing at least one kind of fluororesin, externally disposed on the third layer, and filling voids in the third layer, and at least one selected from a group consisting of a cleaning member, a charging member, a transferring member, an intermediate transferring member and a transporting member.

DESCRIPTION OF THE PREFERRED EMBODIMENTS

The following description will discuss an electrophotographic photoreceptor, an electrophotographic member, a process cartridge and an image forming apparatus that relate to the present invention. The electrophotographic member of the invention includes, for example, charging member; transferring member; a primary transferring member, a secondary transferring member and an intermediate transferring member in an intermediate transferring system; cleaning member and conveying member, and not particularly limited, this member may be any member as long as it is used for an electrophotographic process, and needs to have a superior mold-releasing property and a sliding property.

Electrophotographic Photoreceptor

The electrophotographic photoreceptor of the invention is characterized in containing at least the first layer and the second layer which is the outermost layer externally contacted with the first layer and contains one or more of fluororesins.

Thus, there can be maintained for a long time chemical resistance for ozone and NOx which are generated at charging, and the like by making the outermost layer of the photoreceptor as the second layer which contains one or more of fluororesins (hereinafter, sometimes referred to simply as "the second layer"), in addition to various properties such as the mold-releasing property for enhancing transferring efficiency, surface lubricity at mechanical cleaning, frictional resistance and hardness.

Hereat, the above-mentioned first layer is a layer supporting the second layer being the above-mentioned outermost layer, and not specifically limited so far as it is a layer whose surface is contacted with the second layer. Further, as described later, the first layer may be a mono layer, and a layer in which a plural number of layers are laminated.

Figure 1:
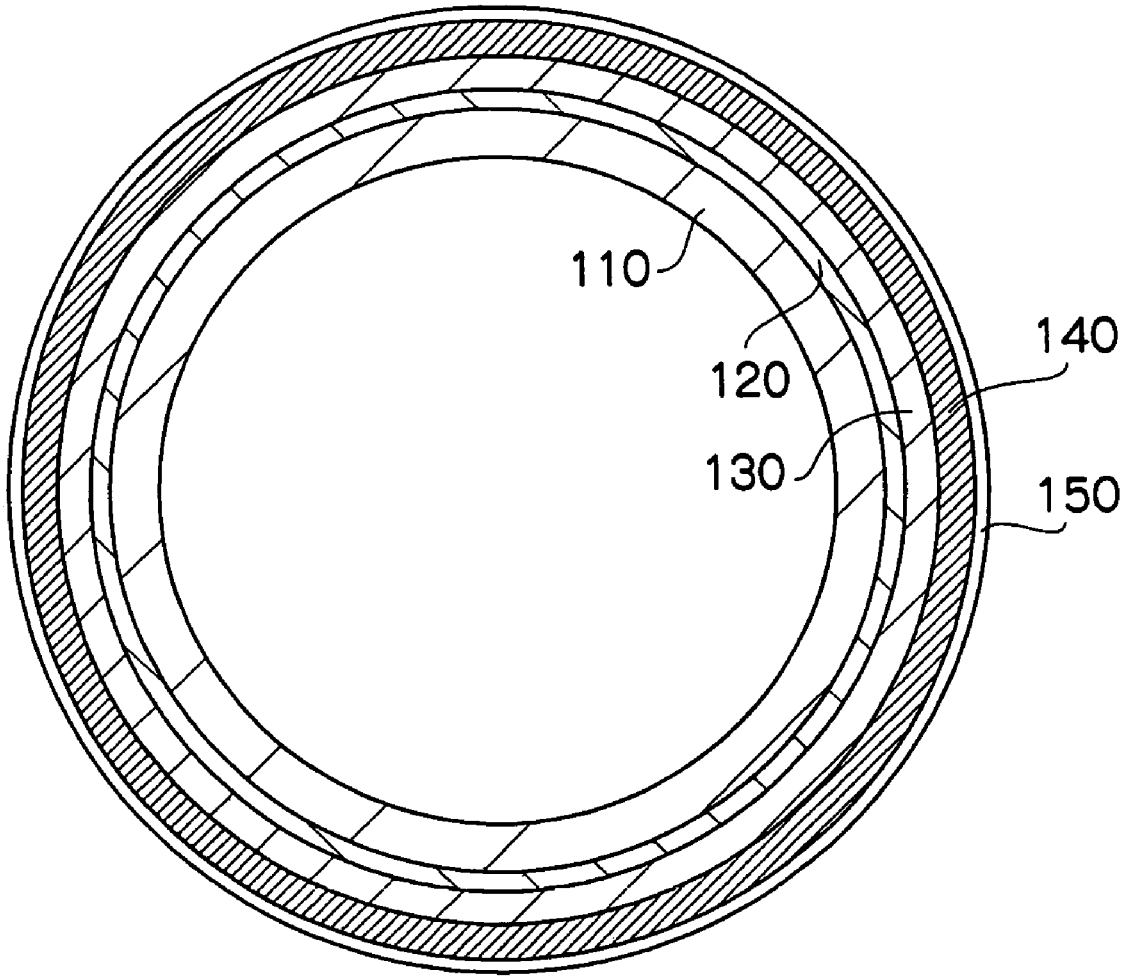
FIG. 1 is a schematic cross-sectional view that explains a structure of an electrophotographic photoreceptor showing one embodiment of the present invention.
Figure 2:
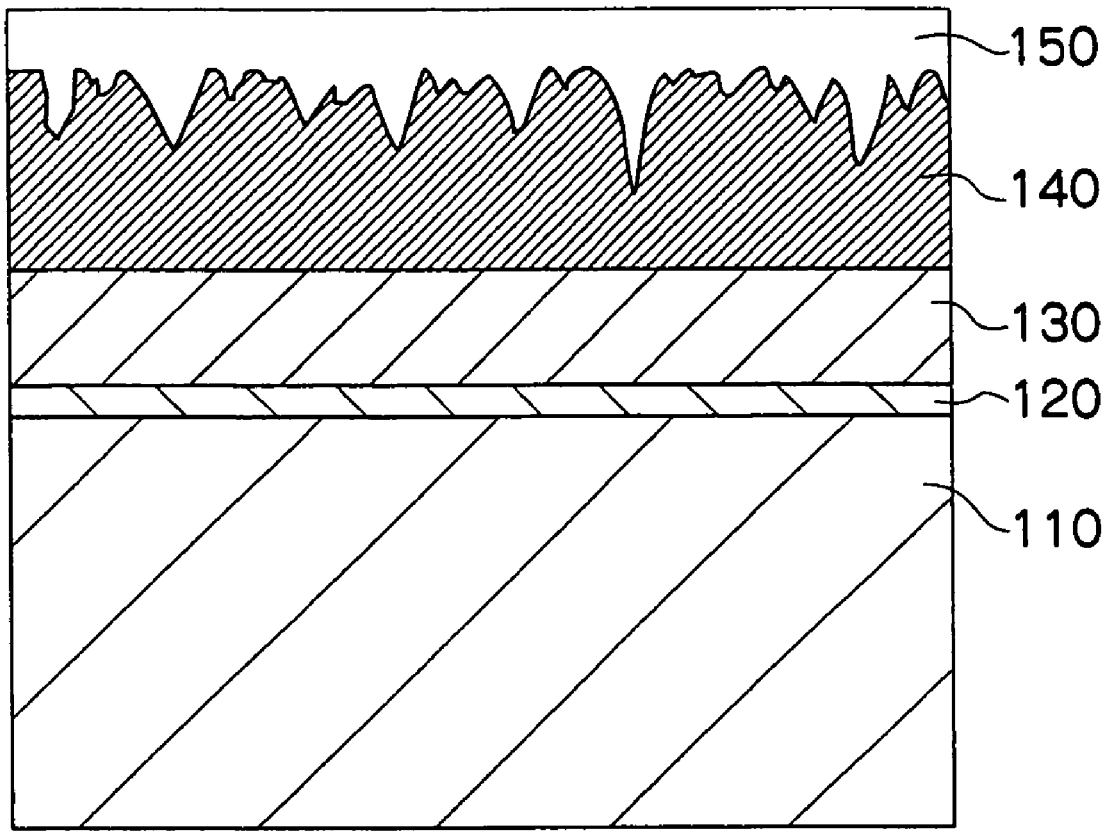
FIG. 2 is a schematic cross-sectional view that shows an essential portion so as to explain the layer structure of an electrophotographic photoreceptor showing the embodiment of the invention of FIG. 1.

Referring to FIGS. 1 and 2, the following description will discuss an electrophotographic photoreceptor that is one embodiment of the invention in detail. Here, FIG. 1 is a schematic cross-sectional view that explains a structure of an electrophotographic photoreceptor showing one embodiment of the invention. FIG. 2 is a schematic cross-sectional view that shows an essential portion so as to explain the layer structure of an electrophotographic photoreceptor showing the embodiment of the invention of FIG. 1.

As shown in FIGS. 1 and 2, an electrophotographic photoreceptor in accordance with one embodiment of the invention is provided with a base layer 120, a charge-generating layer 130, a charge-transporting layer 140 and a fluororesin-containing layer 150 (the second layer) that are successively stacked on a conductive support 110; however, the electrophotographic photoreceptor of the invention is not intended to be limited by this structure. In the electrophotographic photoreceptor shown in FIG. 1, the charge-generating layer 130 and the charge-transporting layer 140 are formed as respectively different layers to form a photosensitive layer having a two-layer structure of a so-called function-separation type in which a charge-generating function and a charge-transporting function are provided in a separated manner. However, for example, the photosensitive layer of the electrophotographic photoreceptor of the invention may be formed as a single layer that commonly has both of a charge-generating function and a charge-transporting function, by further dispersing a charge-generating material in a composition prepared by dispersing or dissolving a charge-transporting material in a binder resin.

The first layer in the invention preferably is composed of two layers of the charge-generating layer and the charge-transporting layer in the case of the above-mentioned photoreceptor having the function-separation type photosensitive layer, and in this case, a layer contacted with the second layer may be the charge-transporting layer and may be the charge-generating layer. When the photosensitive layer is composed of a mono layer structure in which the charge-generating material is further dispersed in a composition in which the above-mentioned charge-transporting material is dispersed or dissolved, the first layer in the invention is preferably a single layer having the above-mentioned charge-generating function and charge-transporting function in combination.

The following description will discuss the conductive support 110 and the respective layers 120 to 150.

The Second Layer Which Contains One or More of Fluororesins

The second layer in the invention becomes the outermost layer which is brought into contact with the first layer and required to contain one or more of fluororesins. In the electrophotographic photoreceptor of the invention, it is essential to have a layer containing one or more of fluororesins as the outermost layer.

Namely, the fluororesin-containing layer 150 which is the second layer in FIG. 1 may be constituted by a single fluororesin, and may be constituted by two or more fluororesins. Further, the second layer is enough to contain the fluororesin, and may contain other resin in addition to the fluororesin.

Further, in the invention, it is preferable that the above-mentioned second layer fills the voids of the surface of the above-mentioned first layer. Here, "filling the void of the surface of the first layer" indicates a condition in which the fluororesin-containing layer 150 is inserted into the micro voids (a concave portion) at a molecular level which exist at the surface of the charge-transporting layer 140 that is internally contacted and fills the voids and the outermost surface is covered with the fluororesin-containing layer 150 as shown in FIG. 2.

However, in the invention, the above-mentioned outermost surface may be not perfectly covered with the fluororesin, and for example, as the fluororesin-containing layer 150 in FIG. 1, there are also contained not only a perfect fluororesin-containing layer but also a layer (a quasi layer) in which the convex portion of the charge-transporting layer 140 having the micro voids exists partially in mixture.

Here, the voids located in the surface of the layer that is internally made in contact with the fluororesin-containing layer 150 (in the present embodiment, the charge-transporting layer 140) refer to those voids that have been formed by the existence of gas such as air that is mixed therein when the layer internally contacting the fluororesin-containing layer 150 is placed; thus, the gas is replaced by the fluororesin so that the fluororesin-containing layer is further formed into the layer (the inside of the voids) that is internally made in contact with the fluororesin-containing layer 150.

In this manner, since the outermost surface layer of the electrophotographic photoreceptor of the invention is composed of the second layer which contains one or more of fluororesins (hereinafter, sometimes referred to simply as the "fluororesin-containing layer"), it is possible to provide a high mold-releasing property and sliding property, and since the fluororesin-containing layer is inserted into the layer that is internally made in contact with the fluororesin-containing layer, even when the outermost surface layer is ground through abrasion and the layer internally contacting the fluororesin-containing layer is exposed, the fluororesin is allowed to exist; therefore, it is possible to maintain a high mold-releasing property and sliding property for a long time. Moreover, since the fluororesin-containing layer is inserted into the layer internally contacting the fluororesin-containing layer, the adherence force between the layer (first layer) internally contacting the fluororesin-containing layer and the fluororesin-containing layer (second layer) is maintained at a high level.

With respect to a method for forming the fluororesin-containing layer 150 as shown in FIG. 2, although not particularly limited, the following impregnating process is preferably used.

In the impregnating process of the invention, a treatment solution having a specific composition is used, and the treatment solution is applied to the surface of a laminated member in which the base layer 120, the charge-generating layer 130 and the charge-transporting layer 140 have been formed on the surface of the conductive support 110, by using, for example, an impregnating method or a coating method.

The above-mentioned treatment solution is preferably the dispersion solution of a fluororesin (hereinafter, referred to as the specific fluororesin, if necessary) containing at least one of a homopolymer and a copolymer of a tetrafluoroethylene, and in particular, it is preferable to be used by mixing the homopolymer and copolymer of tetrafluoroethylene at a proper ratio, for example, at a ratio of (homopolymer):(copolymer)=95:5 to 10:90. It is more preferable to used at a ratio of (homopolymer):(copolymer)=90:10 to 20:80.

Moreover, with respect to the fluororesin in the treatment solution, in addition to the above-mentioned specific fluororesin, another fluororesin may be used in combination. With respect to fluororesins that are applicable in combination, at least one of a homopolymer and a copolymer of vinylidene, at least one of a homopolymer and a copolymer of chlorotrifluoroethylene, and the like may be used. The compounding amount of these fluororesins which can be used in combination is preferably in the range of 5 to 100 parts by mass based on the 100 parts by mass of the specific fluororesin.

Further, as a comonomer in the above-mentioned specific fluororesin and the copolymer of the fluororesin that is applicable in combination, there are exemplified an olefin, a fluorine-containing olefin, a perfluoroolefin, a fluoroalkyl vinyl ether and the like. The copolymerization ratio of these comonomer is preferably in the range of 0.01 to 1% by mol when the repeating unit in the copolymer is made as 1 mol, and more preferably in the range of 0.02 to 0.9% by mol.

Further, as the other resin in case where other resin other than the fluororesin is contained in the fluororesin-containing layer, a polyolefin resin, a silicone resin, a polyester resin and the like are preferably used. Further, the compounding amount of the other resin when these other resins are contained is preferably in the range of 1 to 100 parts by mass based on the 100 parts by mass of the above-mentioned fluororesin.

The above-mentioned treatment solution having the specific fluororesin as a preferable component, which is used in the form of an aqueous dispersion solution using water as a main dispersion medium, is applied to the surface of the laminated member constituted by the above-mentioned conductive support and respective layers.

Upon preparation of the treatment solution serving as the aqueous dispersion solution, various anionic, nonionic, cationic or ampholytic surfactants are blended, and the above-mentioned fluororesin is preferably dispersed therein evenly. Moreover, with respect to the aqueous dispersion solution also, an appropriate amount of an organic solvent is preferably used in combination. By appropriately adjusting the surfactants and the solvent, it is possible to stably disperse the fluororesin in the aqueous dispersion solution evenly, and also to allow the fluororesin-containing resin to smoothly permeate the surface of the above-mentioned laminated member to be dispersed therein.

In addition to these, wax, a brightener, a stabilizer, an ultraviolet ray absorber, a pH-adjusting agent, polyhydric alcohol, a softener, a viscosity-adjusting agent, etc. may be added to the treatment solution having the above-mentioned specific fluororesin as a preferable component, if necessary.

It is preferable that the concentration of solid components in the treatment solution is set in the range of approximately 10 to 70% by mass, and the concentration of the fluororesin in the treatment solution is further set in the range of 0.1 to 30% by mass; however, the invention is not intended to be limited to these ranges.

With respect to the forming method of the fluororesin-containing layer, the following application-impregnating process, heat-impregnating process, vacuum-impregnating process or pressure-impregnating process may be preferably used.

The above-mentioned application-impregnating process is carried out by coating the above-mentioned treatment solution on the surface of the laminated member constituted by the above-mentioned conductive support and the respective layers, and leaving this for a predetermined period of time. In this case, the amount of application to the surface of the above-mentioned laminated member is preferably adjusted to set the thickness of the treatment solution in the range of 5 to 20 μm. For this purpose, the concentration of the treatment solution is desirably adjusted, and the concentration of the solid in the treatment solution is set in the range of 5 to 50% by mass. Thereafter, the treatment solution on the surface of the laminated member is left for a predetermined time so as to permeate the inside of the laminated member, and dried to form a coat film.

Therefore, in the case where the thickness of the treatment solution is thinner than 5 μm, the coat film thus formed tends to have extremely thin portions, resulting in an outermost surface layer having an insufficient mold-releasing property. The electrophotographic photoreceptor having such an outermost surface layer has portions that have locally different transfer efficiencies due to differences in the mold-releasing property, with the result that defective images might be generated due to these portions. In contrast, in the case where the thickness of the applied treatment solution is greater than 20 μm, the treatment solution tends to flow causing differences in the thickness of the coat film to be formed. This case also causes the possibility of defective images.

Moreover, the predetermined time during which the treatment solution is left is preferably set in the range of not less than 15 minutes, more preferably, not less than 30 minutes. In the case where the curing time is less than 15 minutes, the amount of the fluororesin contained in the above-mentioned laminated member becomes smaller, and the insufficient drying time tends to cause a failure in forming a coat film having sufficient strength.

The heat-impregnating process is carried out by applying the above-mentioned treatment solution to the surface of the above-mentioned laminated member constituted by the conductive support and the respective layers and maintaining this at a temperature higher than normal temperature.

Moreover, the vacuum-impregnating process is carried out by applying the above-mentioned treatment solution to the surface of the laminated member and repeatedly maintaining this in a reduced-pressure state and a normal-pressure state at a temperature higher than normal temperature.

Furthermore, the pressure-impregnating process is carried out by applying the above-mentioned treatment solution to the surface of the laminated member and repeatedly maintaining this in a pressure-applied state and a normal-pressure state at a temperature higher than normal temperature.

With respect to the method for applying the treatment solution to the surface of the laminated member in the heat-impregnating process, the vacuum-impregnating process and the pressure-impregnating process, the following methods are proposed: a method in which the laminated member is immersed in the treatment solution, a method in which, after the laminated member has been preliminarily fixed into a container, the treatment solution is poured into the container, and application methods in which the treatment solution is applied by using a coating method such as a blade coating method, a wire-bar coating method, a spray coating method, an immersion coating method, a beads coating method, an air-knife coating method and a curtain coating method.

In the heat-impregnating process, the vacuum-impregnating process and the pressure-impregnating process, the term, "at a temperature not less than normal temperature", refers to a range from 10 to 100° C., preferably, 40 to 80° C. The temperature higher than 100° C. might cause a deformation in the resulting coat film due to a thermal expansion and a thermal shrinkage in the fluororesin-containing layer. In contrast, the temperature lower than 10° C. might cause degradation in the manufacturing efficiency since the drying process requires a long period of time.

Further, the degree of vacuum in the vacuum-impregnating process is preferably set in the range of 0.01 MPa or more to 0.9 MPa or less, and more preferably, in the range of 0.015 MPa or more to 0.09 MPa or less.

Moreover, the applied pressure in the pressure-impregnating process is preferably set in the range of 0.1 to 1 MPa or less, and more preferably, in the range of 0.11 to 0.9 MPa.

When the vacuum in the vacuum-impregnating process is less than 0.01 MPa, the evaporating amount of a low boiling point solvent in the treatment solution becomes much, and the life time of the treatment solution becomes short. Further, when the vacuum is larger than 0.09 MPa, the removal of residual gas in the layer impregnated is insufficient and the fluororesin is not occasionally permeated sufficiently.

Similarly, the applied pressure in the pressure-impregnating process is preferably a pressure larger than 0.1 MPa or more in order to sufficiently fill the fluororesin in the details of the voids. When the applied pressure is larger than 1 MPa, production cost becomes occasionally high because a high pressure resistance is required for a treatment facility.

In this case, treatment conditions such as the fluororesin-containing resin concentration in the treatment solution, the adjustment of solid components in the treatment solution (viscosity adjustment), the temperature, the degree of vacuum, the applied pressure of the treatment solution, the number of times in which the reduced-pressure state and the normal-pressure state, as well as the pressure-applied state and the normal-pressure state, are repeated, may be desirably combined in accordance with an electrophotographic photoreceptor to be obtained.

After the treatment solution is applied to the surface of the laminated member formed by the above-mentioned conductive support and the respective layers and the various impregnating processes have been completed, excessive treatment solution is removed, and the resulting laminated member is dried at 40 to 80° C., more preferably, 50 to 70° C., for approximately 5 to 30 minutes; thus, the target fluororesin-containing layer is formed, and concave portions in the internally contacting layer are filled and shielded.

In an attempt to provide a superior sliding property to the fluororesin-containing layer 150 (the second layer), the coefficient of dynamic friction on its surface is preferably set in the range of not more than 0.5, more preferably, not more than 0.3.

Conductive Supporting Member

With respect to the conductive support 110, examples thereof include: a metal plate, a metal drum and a metal belt using metal or alloy such as aluminum, copper, zinc, stainless, chromium, nickel, molybdenum, vanadium, indium, gold and platinum; conductive compounds such as conductive polymer and indium oxide; and paper, plastic film and belt on which metal or alloy such as aluminum, palladium and gold is applied, vapor-deposited, or laminated. Moreover, if necessary, the surface of the conductive support 110 may be subjected to various treatments as long as these treatments are set in a range so as not to give any adverse effects to the image quality. For example, these treatments include an anode-oxidizing coat-film treatment, a hot-water oxidizing treatment and a chemical treatment and a coloring treatment, or an irregular reflection treatment, such as a sandblasting treatment.

Base Layer

The base layer 120 is provided between the conductive support 110 and the charge-generating layer 130 which will be described later, in the electrophotographic photoreceptor in FIG. 1, if necessary. It may be provided between the conductive support 110 and the charge-transporting layer, or the layer having the charge-generating function and the layer having the charge-transporting function depending on the constitution of the photoreceptor.

When the base layer 120 is provided, it can mainly prevent the injection of unnecessary carriers from the conductive support 110 to improve the image quality, and 2) also prevent environmental variations in the light retardation curve of the photoreceptor, therefore provide stable image quality. Moreover, since the base layer 120 has 3) an appropriate charge-transporting function to prevent accumulation of charge even after repetitive use for a long period of time and consequently to prevent variations in sensitivity, 4) an appropriate voltage-resisting property to prevent the generation of a defective image due to insulation failure. Moreover, the base layer 120 exhibits an action as 5) an adhesive layer which allows the photosensitive layer to integrally adhere to the conductive support 110, and, in some cases, exhibits 6) an action for preventing the conductive support 110 from reflecting light.

The base layer 120 can use organic zirconium compounds such as a zirconium chelate compound, a zirconium alkoxide compound and a zirconium coupling agent; organic titanium compounds such as a titanium chelate compound, a titanium alkoxide compound and a titanate coupling agent; organic aluminum compounds such as an aluminum chelate compound and an aluminum coupling agent; and additionally, organometallic compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound and an aluminum zirconium alkoxide compound. Among these, organic zirconium compounds, organic titanium compounds and organic aluminum compounds are preferably used because residual potential is low and good electrophotographic property is exhibited.

Further, the base layer 120 may be formed by compounding in these organometallic compounds, silane coupling agents such as vinyl trichlorosilane, vinyl trimethoxysilane, vinyl triethoxysilane, vinyl tris-2-methoxyethoxysilane, vinyl triacetoxysilane, γ-glycidoxytrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercapropropyltrimethoxysilane, γ-ureidopropyltriethoxysilane, and β-3,4-epoxycyclohexyltrimethoxysilane.

There can be used known binder resins such as a polyvinyl alcohol, a poly (vinyl methyl ether), a poly-N-vinyl imidazole, a polyethylene oxide, ethylcellulose, methylcellulose, an acryl resin, a methacryl resin, an ethylene-acrylic acid copolymer, a polyamide, a polyimide, casein, gelatin, a polyethylene, a polypropylene, a polyester, a polycarbonate, a phenol resin, a vinyl chloride resin, a vinyl acetate resin, a vinyl chloride-vinyl acetate copolymer, a vinylidene chloride resin, a polyvinyl acetal resin, an epoxy resin, a poly (vinyl pyrrolidone), a poly(vinyl pyridine), a melamine resin, a benzoguanamine resin, a polyurethane, a polyglutamic acid, nitrocellulose, starch, starch acetate, aminostarch, a poly(acrylic acid) and a poly(acrylic amide), which are conventionally used for the base layer 120.

Further, an electron transporting pigment can be used by being mixed and dispersed with the base layer 120. As the electron transporting pigment, there are mentioned organic pigments such as a perylene pigment, a benzimidazole perylene pigment, a polycyclic quinone pigment, an indigo pigment and a quinacridone pigment; organic pigments such as a bis azo pigment having an electron attractive substituent such as a cyano group, a nitro group, a nitroso group and a halogen atom, and a phthalocyanine pigment; and inorganic pigments such as zinc oxide and titanium oxide. Among these pigments, aperylene pigment, a benzimidazole perylene pigment and a polycyclic quinone pigment are preferably used because they have high electron transferring property.

When the mixing amount of the electron transporting pigment is too much, the strength of the base layer 120 is lowered and the defects of the coating is generated, therefore it is preferably used at 95% by mass or less and more preferably at 90% by mass or less.

As the method for mixing and dispersing the above-mentioned electron transporting pigment, a method of using a ball mill, a roll mill, a sand mill, an attoliter, super sonic wave and the like is applied. The mixing and dispersion are carried out in an organic solvent, and as the organic solvent, any one can be used so far as it dissolves an organometallic compound and a resin and does not generate gelation and flocculation when the electron transporting pigment is mixed and dispersed. For example, there can be used usual organic solvents alone or a mixture of one or more of them such as methanol, ethanol, n-propanol, n-butanol, benzyl alcohol, methylcellosolve, ethylcellosolve, acetone, methyl ethyl ketone, cyclohexanone, methyl acetate, n-butyl acetate, dioxane, tetrahydrofuran, methylene chloride, chloroform, chlorobenzene and toluene.

Further, as the coating method of coating a coating solution for the base layer 120 on the surface of the conductive support 110, there can be used normal methods such as a blade coating method, a wire-bar coating method, a spray coating method, an immersion coating method, a beads coating method, an air-knife coating method and a curtain coating method. The base layer is obtained by drying the coated article, but the drying is usually carried out at a temperature at which the solvent is evaporated and film forming is possible. In particular, a substrate (the conductive support) to which an acidic solution treatment and a boehmite treatment have been carried out tends to be insufficient in the defect covering capacity of the substrate, therefore an intermediate layer is preferably formed.

The thickness of the base layer 120 is preferably set in the range of 0.01 to 30 μm and more preferably 0.2 to 25 μm.

Charge-Generating Layer

Normally, a charge-generating layer 130 is formed on the surface of the conductive support 110 (on the surface of the base layer 120 in the case where the base layer 120 has been formed). The charge-generating layer 130 contains at least a charge-generating substance. With respect to the charge-generating substance to be used as the charge-generating layer 130, examples thereof include: azo-based pigments such as bis azo and tris azo, quinone-based pigments, condensed ring aromatic pigments such as dibromoanthroanthrone, perylene-based pigments, pyropyrrole-based pigments, indigo-based pigments, thioindigo-based pigments, bisbenzoimidazole-based pigments, phthalocyanine-based pigments, quinacridone-based pigments, quinoline-based pigments, lake-based pigments, azolake-based pigments, anthraquinone-based pigments, oxazin-based pigments, dioxazin-based pigments and triphenyl methane-based pigments; various dyes such as azulenium-based dyes, squarylium-based dyes, pyrylium-based dyes, triallylmethane-based dyes, xanthene-based dyes, thiazine-based dyes and cyanine-based dyes; inorganic materials, such as amorphous silicone, amorphous selenium, tellurium, selenium-tellurium alloy, cadmium sulfide, antimony sulfide, zinc oxide and zinc sulfide; and the like, and among these, condensed ring aromatic pigments, perylene-based pigments and azo-based pigments are preferably used from the viewpoint of the sensitivity, electrical stability and photochemical stability with respect to irradiation light.

Among these, metal and/or non metal phthalocyanine pigments, condensed ring aromatic pigments, perylene-based pigments and azo-based pigments are preferable, and in particular, hydroxygallium phthalocyanine which is disclosed in JP-A Nos. 5-263007, 5-279591 and the like, chlorogallium phthalocyanine which is disclosed in JP-A No. 5-98181 and the like, dichlorotin phthalocyanine which is disclosed in JP-A No. 5-140473 and the like, titanyl phthalocyanine which is disclosed in JP-A Nos. 4-189873, 5-43823 and the like are more preferable.

With respect to the charge-generating substance, those described above may be used alone, or two or more kinds of those may be used in a mixed state.

With respect to the binder resin to be used for the charge-generating layer 130, there can be selected from wide insulating resins such as polyvinyl acetal-based resins such as a polyvinyl butyral resin, a polyvinyl formal resin and a partially acetalized polyvinyl acetal resin in which one portion of butyral is modified by formal and acetoacetal or the like, a polyamide-based resin, a polyester resin, a modified-ether-type polyester resin, a polycarbonate resin, an acrylic resin, a polyvinyl chloride resin, poly(vinylidene chloride) resin, a polystyrene resin, a polyvinylacetate resin, a vinyl chloride-vinyl acetate copolymer, a silicone resin, a phenol resin, a phenoxy resin, a melamine resin, a benzoguanamine resin, an urea resin, a polyurethane resin and the like. Further, it can be also selected from organic photoconductive polymers such as a poly-N-vinyl carbazole resin, a polyvinyl anthracene resin, a polyvinyl pyrene and a polysilane.

Among the preferable binder resin, there are mentioned thermoplastic resins such as a poly(vinyl butyral) resin, a polyarylate resin (a polycondensate of bisphenol-A and phthalic acid, and the like), a polycarbonate resin, a polyester resin, a phenoxy resin, a vinyl chloride-vinyl acetate copolymer, a polyamide resin, an acryl resin, a poly(acryl amide) resin, a poly(vinyl pyridine) resin, a cellulose resin, an urethane resin, an epoxy resin, casein, a poly (vinyl alcohol) resin and a poly(vinyl pyrrolidone) resin. These binder resins can be used alone and a mixture of two or more can be used.

The compounding ratio of the above-mentioned charge-generating substance and the binder resin is preferably within the mass ratio range of 10:1 to 1:10, and more preferably in the range of 10:2 to 2:10.

The charge-generating layer 130 can be formed by depositing the above-mentioned charge-generating substance by vacuum evaporation, or by coating a coating solution which is obtained by dissolving and dispersing the binder resin and the charge-generating substance in a solvent.

With respect to the solvent, there are mentioned methanol, ethanol, n-propanol, n-butanol, benzyl alcohol, methylcellosolve, ethylcellosolve, acetone, methyl ethyl ketone, cyclohexanone, methyl acetate, n-butyl acetate, dioxane, tetrahydrofuran, methylene chloride, chloroform, chlorobenzene, toluene and the like. These can be used alone or a mixture of two or more can be used.

Further, as the method for mixing the charge-generating substance and the binder resin in a solvent, usual methods such as a ball mill dispersion method, an attoliter dispersion method, a sand mill dispersion method, and the like can be used. The variation of the crystal type of the charge-generating substance by dispersion can be prevented by these dispersion methods. Further, it is effective to set the average particle size of the charge-generating substance to be 0.5 μm or less, preferably 0.3 μm or less and more preferably 0.15 μm or less.

When the charge-generating layer 130 is formed, there can be used usual methods such as a blade coating method, a wire-bar coating method, a spray coating method, an immersion coating method, a beads coating method, an air-knife coating method and a curtain coating method. The thickness of the charge-generating layer 130 is preferably set in the range of 0.01 to 5 μm, and more preferably 0.2 to 2.0 μm.

The thickness thinner than 0.01 μm makes it difficult to evenly form the charge-generating layer 130, while the thickness exceeding 5 μm tends to cause serious degradation in the electrophotographic properties.

Moreover, a stabilizer such as an antioxidant and a deactivator may be added to the charge-generating layer 130. With respect to the antioxidant, examples thereof include: antioxidants of phenol-based, sulfur-based, phosphor-based, and amine-based compounds. With respect to the deactivator, examples thereof-include: bis(-dithiobenzyl) nickel and nickel di-n-butylthiocarbamate. An oxidant is described later.

Charge-Transporting Layer

The charge-transporting layer 140 is made from the following charge-transporting substance, binder resin and various additives that are added if necessary.

In particular, as the charge-transporting substance, there are preferably used the electron-transporting compounds such as quinone-base compounds such as p-benzoquinone, chloranil, bromanil and anthraquinone; fluorenone compounds such as a tetracyanoquinodimethane-base compound and 2,4,7-trinotrofluorenone; xanthone-base compounds, benzophenone-base compounds, cyanovinyl-base compounds and ethylene-base compounds; and the positive hole-transporting compounds such as a triarylamine compound, a benzidine-base compound, an arylalkane-base compound, an aryl-substituted ethylene-base compound, a stilbene-base compound, an anthracene-base compound, and a hydrazone-base compound. These charge-transporting materials can be used alone or a mixture of two or more can be used. The substances having the structure indicated in the formulae (1) to (3) below are preferable from the viewpoint of mobility.

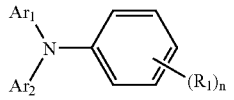

(1)

$R_1$ indicates a hydrogen atom or a methyl group in the above-mentioned formula (1). Further, n means 1 or 2. $Ar_1$ and $Ar_2$ indicate a substituted or unsubstituted aryl group, and indicate a substituted amino group which is substituted with a halogen atom, an alkyl group having 1 to 5 carbons, an alkoxy group having 1 to 5 carbons, or an alkyl group having 1 to 3 carbons, as the substituent.

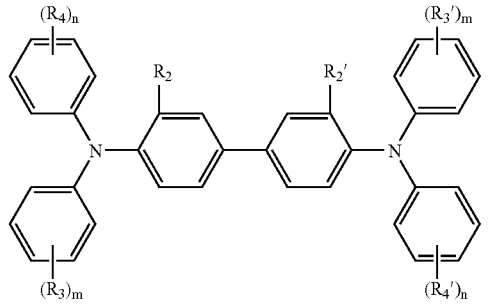

(2)

In the formula (2), $R_2$ and $R_2$, maybe the same or different, and represent a hydrogen atom, a halogen atom, an alkyl group having 1 to 5 carbons, an alkoxy group having 1 to 5 carbons. $R_3$ and $R_3$, and $R_4$ and $R_4$, may be the same or different, and represent a hydrogen atom, a halogen atom, an alkyl group having 1 to 5 carbons, an alkoxy group having 1 to 5 carbons, an amino group which is substituted with an alkyl group having 1 to 2 carbons, a substituted or unsubstituted aryl group, or —$C(R_5)$=$C(R_6)$ ($R_7$). $R_5$, $R_6$ and $R_7$ represent a hydrogen atom, a substituted or unsubstituted alkyl group, a substituted or unsubstituted aryl group. M and n are integers of 0 to 2.

(3)

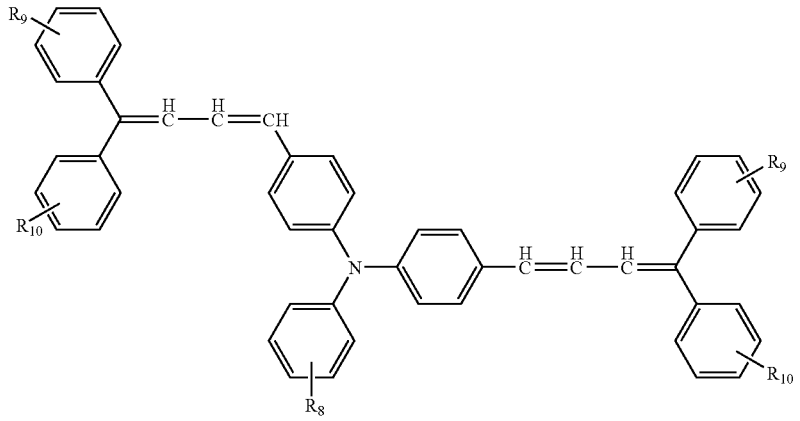

In the formula (3), $R_8$ represents a hydrogen atom, an alkyl group having 1 to 5 carbons, an alkoxy group having 1 to 5 carbons, a substituted or unsubstituted aryl group, or —CH═CH—CH═$(Ar)_2$. Ar represents a substituted or unsubstituted aryl group. $R_9$ and $R_{10}$ may be the same or different, and represent a hydrogen atom, a halogen atom, an alkyl group having 1 to 5 carbons, an alkoxy group having 1 to 5 carbons, an amino group which is substituted with an alkyl group having 1 to 2 carbons, a substituted or unsubstituted aryl group.

Further, a polymer charge-transporting material can be also used as the charge-transporting substance. As the polymer charge-transporting material, there are mentioned a poly-N-vinyl carbazole, a halogenated poly-N-vinyl carbazole, a polyvinyl pyrene, a polyvinyl anthracene, a polyvinyl acridine, a pyrene-formaldehyde resin, an ethyl carbazole-formaldehyde resin, a triphenyl methane polymer, a polysilane and the like. Among these, triphenyl amine compounds, triphenyl methane compounds and benzidine compounds are preferably used from the viewpoint of mobility, stability and transparency to light. In particular, the polyester-base polymer charge-transporting materials which are disclosed in JP-A Nos. 8-176293, 8-208820 and the like have high charge-transporting property, and are preferable, in particular. The polymer charge-transporting material itself can form a film, but a film is formed by mixing it with the binder resin described later.

With respect to the binder resin used for the charge-transporting layer 140, there are mentioned thermoplastic resins such as a polycarbonate resin, a polyester resin, a methacrylic resin, an acrylic resin, a polyvinyl chloride, a poly(vinylidene chloride) resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride, a silicone resin, a silicone-alkyd resin, a phenol-formaldehyde resin, a styrene-alkyd resin, a poly-N-vinyl carbazole, a polyvinyl butyral, a polyvinyl formal, a polysulfone, casein, gelatin, a polyvinyl alcohol, ethyl cellulose, a phenol resin, a polyamide, carboxy-methyl cellulose, a vinylidene chloride-based polymer latex, a polyurethane and a polysilane. In particular, a polycarbonate resin, a polyester resin, a methacrylic resin and an acrylic resin are preferable because compatibility with the charge-transporting substance, solubility to a solvent and strength are superior.

Further, polymer charge-transporting materials such as the polyester-base polymer charge-transporting materials which are disclosed in JP-A Nos. 8-176293 and 8-208820 can be also used as described above. These binder resins can be used alone or a mixture of two or more can be used. The compounding ratio of the charge-transporting substance and the binder resin is preferably in the mass ratio range of 10:1 to 1:5.

Moreover, together with these binder resins, additives such as a plasticizer, a surface-modifier, an antioxidant and a photodegradation inhibitor may be used. With respect to the plasticizer, examples thereof include: biphenyl, biphenyl chloride, terphenyl, dibutyl phthalate, diethylene glycol phthalate, dioctyl phthalate, triphenyl phosphate, methyl naphthalene, benzophenone, chlorinated paraffin, polypropylene, polystyrene and various hydrogen fluorocarbide. With respect to the surface modifier, examples thereof include: silicone oils such as polydimethyl siloxane and polymethylphenyl siloxane. The antioxidant and the photodegradation inhibitor are described later.

When a silicon-containing coating agent in the invention is not used, the above-mentioned respective components are dissolved in an appropriate solvent to prepare a coating solution.

The formation of the charge-transporting layer 140 can be carried out using the coating solution in which the charge-transporting substance and the binder resin are dispersed in a fixed solvent. As the solvent, usual organic solvents such as aromatic hydrocarbons such as benzene, toluene, xylene and chlorobenzene; ketones such as acetone and 2-butanone; halogenated aliphatic hydrocarbons such as dichloromethane, chloroform and chlorinated ethylene; cyclic or linear chain ethers such as tetrahydrofuran and ethyl ether can be used alone, and a mixture of two or more can be used.

With respect to the coating method, any of normal methods, such as a blade coating method, a wire-bar coating method, a spray coating method, an immersion coating method, a beads coating method, an air-knife coating method and a curtain coating method, may be used.

The thickness of the charge-transporting layer 140 is preferably set in the range of 5 to 50 μm, more preferably, 10 to 40 μm. The thickness thinner than 5 μm makes it difficult to carry out a charging operation, and the thickness exceeding 50 μm tends to cause serious degradation in the electrophotographic characteristics.

The antioxidant and the photodegradation inhibitor can be added as various stabilizers in the above-mentioned charge-generating layer 130 and the charge-transporting layer 140, if necessary. As the antioxidant, a hindered phenol-base or a hindered amine-base is desirable, and there may be used known antioxidants such as an organic sulfur-base antioxidant, a phosphite-base antioxidant, a dithiocarbamic acid salt-base antioxidant, a thiourea-base antioxidant and a benzimidazole-base antioxidant. As the photodegradation inhibitor, there are used a benzotriazole-base compound, a benzophenone-base compound, a hindered amine-base compound an the like. The addition amount of these stabilizers is preferably 20% by mass or less and more preferably 10% by mass or less.

As the hindered phenol-base antioxidant, there are mentioned 2,6-di-tert-butyl-4-methylphenol, 2,5-di-tert-butylhydroquinone, N,N'-hexamethylenebis(3,5-di-tert-butyl-4-hydroxycinnamide, 3,5-di-tert-butyl-4-hydroxybenzylphosphonate-diethyl ester, 2,4-bis[(octylthio) methyl]-o-cresol, 2,6-di-tert-butyl-4-ethylphenol, 2,2'-methylenebis(4-methyl-6-tert-butylphenol), 2,2'-methylenebis(4-ethyl-6-tert-butylphenol), 4,4'-butylidenebis(3-methyl-6-tert-butylphenol), 2,5-di-tert-amylhydroquinone, 2-tert-butyl-6-(3-butyl-2-hydroxy-5-methylbenzyl)-4-methylphenylacrylate, 4,4'-butylidenebis (3-methyl-6-tert-butylphenol) and the like.

On the other hand, when the photosensitive layer is composed of a single layer having the above-mentioned charge-generating function and the charge-transporting function (hereinafter, sometimes referred to simply as the "charge-generating/charge-transporting layer"), it is formed containing the charge-generating substance, the charge-transporting substance and the binder resin. As these materials, there can be used those similar as materials which are exemplified in the illustration of the above-mentioned charge-generating layer 130 and the charge-transporting layer 140. The content of the charge-generating/charge-transporting layer is in the range of about 10 to 85% by mass, and preferably in the range of 20 to 50% by mass. Further, the content of the charge-transporting substance is preferably in the range of 5 to 50% by mass. Further, a compound represented by the general formula (1) described later may be added. The method of forming the charge-generating/charge-transporting layer is similar as the method of forming the charge-generating layer 130 and the charge-transporting layer 140. The film thickness of the charge-generating/charge-transporting layer is preferably in the range of 5 to 50 μm and more preferably in the range of 10 to 40 μm.

Surface Protective Layer

The surface protective layer is provided, for example, on the surface of the charge-transporting layer 140, if necessary. The formation of the surface protective layer makes it possible to improve the durability. Further, in this case, a plural number of layers including the surface protective layer, or the surface protective layer and the photosensitive layer become the first layer in the invention.

As the material constituting the surface protective layer, there are required organic functional materials which are stable for not only heat resistance, oxidation stability, weather resistance (light, ozone, radioactive rays), electrical properties (insulating property, corona resistant property), interface properties (mold-releasing property defoaming property, water-repellent property) and chemical stability against ozone, NOx and the like, but also physical stresses such as heat and mechanical force. From these viewpoints, the surface protective layer can be formed by using those in which conductive fine particles are dispersed in the binder resin, those in which lubricating fine particles such as a fluororesin and an acryl resin are dispersed in the charge-transporting material, and hard coat agents such as a silicone-base, an acryl-base and the like.

In order to meet with the above-mentioned requires, the use of a coating agent containing silicon is disclosed as the organic functional materials in the pages 57 to 59 of "Proceedings of IS&T's Eleventh International Congress on Advances in Non-Impact Printing Technologies" and in the specification of Japanese Patent No. 2575536 and JP-A No. 9-190004.NOx. Such coating agents containing silicon make it possible to greatly improve the mechanical strength by a so-called organic-inorganic hybridization in which firm three-dimensional networks of siloxane bonds are formed through a sol-gel method. However, in such coating agents and the like made from an organic material and an inorganic material, since the properties of the two materials are different greatly, the compatibility between them is poor, and in the case where the materials are simply mixed, it is sometimes difficult to form an uniform cured film. Accordingly, in JP-A No. 9-190004, there is disclosed a method of chemically bonding inorganic materials and organic materials directly and firmly to be in homogeneous compatibility, using an organic silicon modified positive-hole transporting compound in which a group (a silicon-containing group) containing silicon and having hydrolysis property is directly introduced in the charge-transporting agent.

Further, as the siloxane-base resin, a crosslinking polysiloxane resin containing the charge-transporting component is preferable, and in particular, the resin which is obtained by polymerizing the silicon-containing compound having the structure represented by the under-mentioned general formula (1) alone, or in combination with other polymerizable compound is specifically preferable from the viewpoints of strength and stability.

$$W(\text{-}D\text{-}SiR_{3-a}Q_a)_b \quad (1)$$

In the above-mentioned general formula (1), W represents one kind selected from an organic group indicating photo carrier-transporting property, R represents a hydrogen atom, an alkyl group and a substituted or unsubstituted aryl group, Q represents a hydrolyzable group, D represents a divalent group, a represents an integer of 1 to 3, and b represents an integer of 2 to 4.

W in the general formula (1) is an organic group indicating photo carrier-transporting property, and induced from a triarylamine-base compound, a benzidine-base compound, an arylalkane-base compound, an aryl-substituted ethylene-base compound, a stilbene-base compound, an anthracene-base compound, a hydrazone-base compound, and a quinone-base compound, a fluorenone compound, a xanthone-base compound, a benzophenone-base compound, a cyanovinyl-base compound, an ethylene-base compound and the like.

Further, R in the general formula (1) represents a hydrogen atom, an alkyl group (preferably an alkyl group having 1 to 5 carbons) and a substituted or unsubstituted aryl group (preferably an aryl group having 6 to 15 carbons), as mentioned above.

Further, the hydrolyzable group represented by Q in the general formula (1) means a functional group which can form a siloxane bond (Si—O—Si) by hydrolysis in the curing reaction of the compound represented by the general formula (1). As the preferable hydrolyzable group, there are specifically mentioned a hydroxy group, an alkoxy group, a methyl ethyl ketoxime group, a diethylamino group, an acetoxy group, a propenoxy group, a chloro group and the like, and among these, a group represented by —OR" (R" is an alkyl group or a trimethylsilyl group having 1 to 15 carbons) is more preferable.

Further, the divalent group represented by D in the general formula (1) is preferably a divalent group represented by $—C_nH_{2n}—$, $—C_nH_{2n-2}—$ and $—C_nH_{2n-4}—$ (n is an integer of 1 to 15, and preferably an integer of 2 to 10), $—CH_2—C_6H_4—$ or $—C_6H_4—C_6H_4—$, an oxycarbonyl group (—COO—), a thio group (—S—), an oxy group (—O—), an isocyano group (—N═CH—), or a divalent group by combination of these two or more. Further, these divalent groups may have a substituent such as an alkoxy group, a phenyl group, an alkoxy group or an amino group. When D is the above-mentioned preferable divalent group, an appropriate flexibility is imparted to an organic silicate skeleton therefore the strength of the layer tends to be improved.

Further, the polymerizable compound which is used in combination with the compound represented by the general formula (1) is not specifically limited so far as it has a group which can be bonded with a silanol group which is generated at hydrolysis of the compound represented by the general formula (1). Specifically, there is mentioned a compound having a group represented by $-D-SiR_{3-a}Q_a$, an epoxy group, an isocyanate group, a carboxyl group, a hydroxy group, halogen and the like. Among these, the compound having a group represented by $-D-SiR_{3-a}Q_a$, an epoxy group and an isocyanate group is preferable because it has stronger mechanical strength. Further, the compound having two or more of these groups in a molecule is preferable because the crosslinking structure of the cured film becomes three dimensional and stronger mechanical property is obtained.

Further, the compound may be used in combination with a mixture of other coupling agent and a fluorine compound in order to adjust the film forming property of a film and the flexibility. As the compound, various silane coupling agents and commercially available silicone-base hard coat agent can be used.

As the silane coupling agent, there can be used vinyl trichlorosilane, vinyl trimethoxysilane, vinyl triethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)-γ-aminopropyltriethoxysilane, tetramethoxysilane, methyltrimethoxysilane, dimethyldimethoxysilane and the like. As the commercially available silicone-base hard coat agent, there can be used KP-85, X-40-9740, X-40-2239 (above agents are manufactured by Shin-etsu Silicone Co., Ltd.), AY-42-440, AY-42-441, AY49-208(above agents are manufactured by Dow Corning Toray Silicone Co., Ltd.), and the like. Further, in order to impart the water repellent property and the like, there may be added fluorine-containing compounds such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, (1H,1H,2H,2H-perfluoroalkyltriethoxysilane, (1H,1H,2H,2H-perfluorodecyltriethoxysilane, and (1H,1H,2H,2H-perfluorooctyltriethoxysilane. The silane coupling agent can be used at an arbitrary amount, but the amount of the fluorine-containing compounds is desirably 0.25-fold or less by the mass based on a compound not containing fluorine. When it exceeds the use amount, a problem happens to occur in the film forming property of the crosslinked film. Further, in order to improve the strength of a film, it is more preferable to use a compound having two or more of substituted silicone group having hydrolysis property which is indicated by $-D-SiR_{3-a}Q_a$ at the same time.

The preparation of the coating solution for the surface layer containing these components is carried out without solvent, or can be carried out using solvents such as alcohols such as methanol, ethanol, propanol and butanol; ketones such as acetone and methyl ethyl ketone; ethers such as tetrahydrofuran diethyl ether and dioxane. The solvent can be used alone, and a mixture of two or more can be used, but a solvent having a boiling point of 100° C. or less is preferable. The amount of the solvent is arbitrarily set, but when it is too little, the compound represented by the general formula (1) is easily precipitated, therefore the amount is used in the range of 0.5 to 30 parts by mass based on one part by mass of the compound represented by the general formula (1) and preferably in the range of 1 to 20 parts by mass.

Further, the reaction temperature when a cyclohexane-base resin is obtained by reacting the above-mentioned components is different depending the kind of raw materials, but the reaction is preferably carried out in the range of −20 to 100° C., more preferably in the range of −10 to 70° C., and further preferably in the range of 0 to 50° C. Further, the reaction time is preferably carried out for in the range of 10 minutes to 100 hours because gelation is easily generated when it is too long.

As the curing catalyst when the cyclohexane-base resin is obtained by reacting the above-mentioned components, there are mentioned protic acids such as hydrochloric acid, acetic acid, phosphoric acid and sulfuric acid; bases such as ammonia and triethylamine; organic tin compounds such as dibutyltin diacetate, dibutyltin dioctoate and stannous octoate; organic titanium compounds such as tetra-n-butyl titanate and tetraisopropyl titanate; organoaluminum compounds such as aluminum buthoxude and aluminum triacetylacetonate; an iron carboxylate, a manganese salt, a cobalt salt, a zinc salt, a zirconium salt, etc. Among these, organic tin compounds, organic titanium compounds, organoaluminum compounds and the metal compound such as a metal carboxylate are preferable from the viewpoint of preservation stability, further a metal acetylacetonate or a acetyl acetate is preferable, and in particular, aluminum triacetylacetonate is preferable.

The amount of the curing catalyst used can be arbitrarily set, but is preferably in the range of 0.1 to 20% by mass based on the total amount of materials which contain the hydrolyzable silicone substituent ($-D-SiR_{3-a}Q_a$) from the viewpoints of the preservation stability, properties, strength and the like, and more preferably in the range of 0.3 to 10% by mass.

The curing temperature can be arbitrarily set, but is set at 60° C. or more for obtaining a desired strength and more preferably 80° C. or more. The curing time can be arbitrarily set if necessary, but is preferably in the range of 10 minutes to 5 hours. Further, after the curing reaction is carried out, it is kept in a condition of high humidity and it is also effective to improve the stabilization of property. Further, surface treatment is carried out using hexamethyldisilazane, trimethylchlorosilane and the like depending on uses, and it can be made hydrophobic.

It is preferable that an antioxidant is added in the surface protective layer for preventing deterioration by oxidative gas such as ozone or the like which are generated from an electrification device. When the mechanical strength of the surface of the photoreceptor is enhanced and the photoreceptor becomes long life, the photoreceptor is brought into contact with the oxidative gas for a long time, therefore longer oxidation resistance than a conventional one is required. As the antioxidant, a hindered phenol-base or a hindered amine-base is desirable, and there may be used known antioxidants such as an organic sulfur-base antioxidant, a phosphite-base antioxidant, a dithiocarbamic acid salt-base antioxidant, a thiourea-base antioxidant and a benzimidazole-base antioxidant. The addition amount of these antioxidants is preferably 20% by mass or less and more preferably 10% by mass or less.

As the hindered phenol-base antioxidant, there are mentioned 2,6-di-tert-butyl-4-methylphenol, 2,5-di-tert-butylhydroquinone, N,N'-hexamethylenebis(3,5-di-tert-butyl-4-hydroxycinnamide, 3,5-di-tert-butyl-4-hydroxybenzylphosphonate-diethyl ester, 2,4-bis[(octylthio)methyl]-O-cresol, 2,6-di-tert-butyl-4-ethylphenol, 2,2'-methylenebis(4-methyl-6-tert-butylphenol), 2,2'-methylenebis(4-ethyl-6-tert-butylphenol), 4,4'-butylidenebis(3-methyl-6-tert-butylphenol), 2,5-di-tert-amylhydroquinone, 2-tert-butyl-6-(3-butyl-2-hydroxy-5-methylbenzyl)-4-methylphenylacrylate, 4,4'-butylidenebis(3-methyl-6-tert-butylphenol) and the like. A reactive group is bonded at the side chain thereof to make a crosslinkable structure.

Further, a resin which dissolves in an alcohol can be added in the surface protective layer for the purposes of discharge gas resistance, mechanical strength, abrasion resistance, particle dispersibility, viscosity control, torque reduction, the control of abrasion amount, the extension of pot life and the like. As the resin soluble in an alcohol-base solvent, there are mentioned polyvinyl acetal-based resins such as a polyvinyl butyral resin, a polyvinyl formal resin and a partially acetalized polyvinyl acetal resin in which one portion of butyral is modified by formal and acetoacetal or the like (for example, SREX B, K and the like manufactured by Sekisui Chemical Co., Ltd.); a polyamide-based resin, a cellulose resin, a phenol resin, an epoxy resin and the like. In particular, a polyvinyl acetal resin is preferable from the viewpoint of electric properties.

The average molecular weight of the above-mentioned resin is preferably in the range of 2,000 to 100,000, and more preferably in the range of 5,000 to 50,000. When the average molecular weight of the above-mentioned resin is less than 2,000, the effect due to the addition of the resin tends to be insufficient, and when it exceeds 100,000, solubility is lowered, the addition amount is limited, and further, it tends to cause bad film forming at coating. Further, the addition amount of the above-mentioned resin is preferably in the range of 1 to 40% by mass, more preferably in the range of 1 to 30% by mass, and further preferably in the range of 5 to 20% by mass. When the addition amount of the above-mentioned resin is less than 1% by mass, the effect due to the addition of the resin tends to be insufficient, and when it exceeds 40% by mass, image fading under high temperature and high humidity tends to be generated.

Further, various fine particles can be added in the surface protective layer for improving the adherence resistance to polluted articles and lubricity of the surface of the electrophotographic photoreceptor. As one example of the fine particles, fine particles containing silicon can be mentioned. The fine particles containing silicon are fine particles containing silicon as the constituting element, and specifically, colloidal silica, silicon fine particles and the like are mentioned. The colloidal silica used as the fine particles containing silicon are selected from those which are obtained by dispersing silica having a mean particle size of 1 to 100 nm and preferably 10 to 30 nm in an acidic or alkaline aqueous dispersion solution, or in organic solvents such as an alcohol, a ketone and an ester, and those which are commercially available in general can be used. The solid content of colloidal silica in the surface protective layer is not specifically limited, but is in the range of 0.1 to 50% by mass based on the total amount of the total solid content in the surface protective layer from the viewpoints of the film forming property, electric properties and strength, and preferably in the range of 0.1 to 30% by mass.

The silicon fine particles used as the fine particles containing silicon are selected from silicone resin particles, silicone rubber particles and silicone surface-treated silica particles, and those which are commercially available in general can be used. These silicon fine particles are spherical and the average particle size is preferably in the range of 1 to 500 nm, and more preferably in the range of 10 to 100 nm. The silicon fine particles are chemically inactive, particles with a small diameter which are excellent in dispersibility into a resin, and further, the content required for obtaining an adequate property is small, therefore the surface property of the electrophotographic photoreceptor can be improved without inhibiting the crosslinking reaction. Namely, the lubricity and water repellent property of the electrophotographic photoreceptor are improved in a condition of being homogeneously taken in the tough crosslinking structure, and the good abrasion resistance and the adherence resistance to polluted articles can be kept for a long period. The content of the silicon fine particles in the surface protective layer is preferably in the range of 0.1 to 30% by mass based on the total amount of the total solid content in the surface protective layer, and more preferably in the range of 0.5 to 10% by mass.

Further, as other fine particles, there are mentioned fluororesin-base fine particles such as a tetrafluoroethylene resin, a trifluoroethylene resin, a hexafluoro ethylene resin, a vinyl fluoride resin and a vinylidene fluoride resin; fine particles consisting of a resin which is obtained by copolymerizing the fluororesin with a monomer having a hydroxy group, which are shown in "The 8$^{th}$ Polymer Material Forum, Preprint page 89", semi conductive metal oxides such as $ZnO—Al_2O_3$, $SnO_2—Sb_2O_3$, $In_2O_3—SnO_3$, $ZnO_2—TiO_2$, $ZnO—TiO_2$, $MgO—Al_2O_3$, $FeO—TiO_2$, $TiO_2$, $SnO_2$, $In_2O_3$, ZnO and MgO.

Further, oils such as an silicone oil can be also added for the similar purposes. As the silicone oil, there are mentioned silicone oils such as dimethylpolysiloxane, diphenhylpolysiloxane and phenhylmethylpolysiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane and phenol-modified polysiloxane; cyclic dimethylcyclosiloxanes such as hexamethylcyclotrisiloxane, octamethylcyclotetrasiloxane, decamethylcyclopentasiloxane and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; a mixture of methylhydrosiloxane; hydrosilyl group-containing cyclosiloxanes such as pentamethylcyclopentasiloxane and phenylhydrocyclosiloxane; vinyl group-containing cyclosiloxanes such as pentavinylpentamethylcyclopentasiloxane, etc.

Further, siloxane-base resin having charge-transporting property and a crosslinking structure has superior mechanical property and additionally, photoelectric property is sufficient, therefore it can be used as the charge-transporting layer 140 of the laminate type photoreceptor. In this case, there can be used usual methods such as a blade coating method, a wire-bar coating method, a spray coating method, an immersion coating method, a beads coating method, an air-knife coating method and a curtain coating method, for formation of layers. However, when a requisite film thickness is not obtained by once coating, the requisite film thickness can be obtained by coating at a plural number of times. When the coating is carried out at a plural number of times, the heating treatment may be carried out at every time of the coating, and also after coating of a plural number of times.

Additives such as an oxidant, a light stabilizer and a thermal stabilizer can be added not only in the above-mentioned charge-generating layer 130 and the charge-transporting layer 140, but also in the above-mentioned respective layers constituting the photosensitive layer of the electrophotographic photoreceptor, in order to prevent the deterioration of the photoreceptor caused by ozone which is generated in a copy machine, and an oxidative gas, or light and heat. For example, as the antioxidant, there are mentioned derivatives such as a hindered phenol, a hindered amine, para-phenylenediamine, an arylalkane, hydroquinone, spirochlomane, spiroindanone and derivatives thereof, an organic sulfur compound, an organic phosphor compound, and the like. As the light stabilizer, there are mentioned derivatives of benzophenone, benzotriazole, dithiocarbamate and tetramethylpiperidine. Further, at least one or more of electron-accepting substance can be contained for the purposes of the improvement of sensitivity, the reduction of residual potential, the reduction of fatigue at repeating usage and the like.

As the electron-accepting substance which can be used for the photoreceptor of the invention, for example, there are mentioned succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroantharaquinone, trinitrofluorenone, picric acid, o-nitrobenzoic acid, p-nitrobenzoic acid, phthalic acid and the like, and the compound represented by the general formula (1). Among these, a fluorenone-base, a quinone-base and a benzene derivative having an electron-attractive substituent such as Cl—, CN—, $NO_2$— and the like are preferable in particular.

The exemplified one embodiment of the photoreceptor of the invention is indicated, but the invention is not limited to this embodiment. In the present embodiment, since the photoreceptor equipped with the function separating type photosensitive layer is exemplified, the layer with which the fluororesin-containing layer is internally brought in contact becomes the charge-transporting layer 140, but in the case of the photoreceptor equipped with the photosensitive layer consisting of a single layer, the single layer having the charge-generating function and the charge-transporting function together becomes the layer with which the fluororesin-containing layer is internally brought in contact. Further, when the above-mentioned surface protective layer is provided, the layer with which the fluororesin-containing layer is internally brought in contact becomes the surface protective layer.

Further, as described above, the charge-generating layer 130, the charge-transporting layer 140 and the like use preferably a thermoplastic resin as the binder resin, therefore when the above-mentioned surface protective layer is not formed, the first layer of the invention becomes a constitution having a layer containing the thermoplastic resin. On the other hand, when the above-mentioned surface protective layer is formed, a curable resin is preferably used for the surface protective layer, therefore the above-mentioned first layer becomes a constitution having a layer containing the curable resin. Further, in this case, since the crosslinking silicone resin is preferably used as the surface protective layer as mentioned above, the first layer has preferably a layer containing silicon.

Electrophotographic Member

The electrophotographic member in the invention is characterized in containing at least the third layer and the fourth layer containing at least one or more of the fluororesins which that is externally disposed on the third layer to be the outermost layer.

Thus, the mold-releasing property of the surface and the lubricity can be enhanced by setting the outermost layer of the electrophotographic member as the fourth layer containing at least one or more of the fluororesins (hereinafter, sometimes referred to simply as the "fourth layer"). Accordingly, it can deal with various problems such as the phenomenon of internal falling at the intermediate transferring member and the bad electrification for a long time to be kept.

Further, the above-mentioned third layer is the layer supporting the fourth layer being the outermost layer, and is not specifically limited so far it is a layer whose surface is brought into contact with the fourth layer. Further, the third layer may be a single layer as described later, and may be a layer in which a plural number of layers are laminated. Namely, although the materials constituted are different, the above-mentioned third layer corresponds to the first layer in the above-mentioned electrophotographic photoreceptor of the invention, and the above-mentioned fourth layer corresponds to the second layer in the above-mentioned electrophotographic photoreceptor of the invention.

As the electrophotographic member of the invention, for example, there are preferably mentioned the charging member, the transferring member, the primary transferring member in the intermediate transferring system, the secondary transferring member and the intermediate transferring system, the cleaning member, the conveying member and the like other than the already-described electrophotographic photoreceptor.

The following description will discuss the respective electrophotographic members; however, the invention is not intended to be limited by these embodiments.

As the charging member as the electrophotographic photoreceptor of the invention, the constitution is not specifically limited so far as it is brought into contact with (abutted on) the photoreceptor to evenly charge the surface of the photoreceptor, and examples thereof include a contact-type charging member and the like, which uses conductive or semi-conductive rolls, brushes, films, rubber blades, and the like.

As the transferring member as the electrophotographic photoreceptor of the invention, the constitution is not specifically limited so far as it is abutted on the photoreceptor through a transferring material to transfer a toner image on the surface of the photoreceptor to the transferring member; and there are mentioned a contact-type transferring member and the like such as a transferring roller which is made in press-contact with the rear face of a semi-conductive belt bearing a transferring material and transfers a toner image onto the transferring material.

As the intermediate transferring member in the intermediate transferring system as the electrophotographic photoreceptor of the invention, the constitution is not specifically limited so far as it is abutted on the photoreceptor to transfer a toner image on the surface of the photoreceptor; and for example, there are mentioned the intermediate transferring member and the like having a shape such as a belt shape and a drum shape.

As the primary transferring member in the intermediate transferring system as the electrophotographic photoreceptor of the invention, the constitution is not specifically limited so far as it is abutted on the intermediate transferring member to transfer a toner image on the surface of the electrophotographic photoreceptor to the intermediate transferring member; and for example, there are mentioned a contact-type transferring member and the like which uses a belt, a roller, a film, a rubber blade, and the like.

As the secondary transferring member in the intermediate transferring system as the electrophotographic photoreceptor of the invention, the constitution is not specifically limited so far as it is abutted on the intermediate transferring member through a transferring material to transfer a toner image on the surface of the intermediate transferring member to the transferring member; and there are mentioned the contact-type transferring member and the like such as a transferring roll which has been exemplified as the above-mentioned transferring member.

As the conveying member as the electrophotographic photoreceptor of the invention, the constitution is not specifically limited so far as it can bear a transferring material and transport this; and for example, a conductive or semi-conductive belt and the like are mentioned.

As the cleaning member as the electrophotographic photoreceptor of the invention, the constitution is not specifically limited so far as it is allowed to contact the photoreceptor to remove a residual toner on the surface of the photoreceptor; and for example, there are mentioned the contact-type cleaning member and the like such as blades, rolls and brushes. In particular, with respect to the cleaning member, in the fluororesin-containing layer (the fourth layer) that forms the outermost surface layer thereof, the coefficient of dynamic friction of its surface is preferably set in the range of not more than 1.0, and more preferably, not more than 0.8, from the viewpoint of expressing a superior sliding property.

Hereat, the above-mentioned charging member and the cleaning in the invention are further illustrated.

In the invention, known charging system is applicable as the charging system for the electrophotographic photoreceptor, and for example, a colotrone charging system, a contact charging system and the like are mentioned, but the contact charging system is preferable from the viewpoints of environmental load, cost down and the like. In the contact charging system, there is used the contact charging member which used a roll charging member, a blade charging member, a belt charging member, a brush charging member, a magnet brush charging member and the like. In particular, the roll charging member and the blade charging member may be arranged in a contact condition against the photoreceptor, or in a condition in which a certain degree of voids (100 μm or less) are provided.

Further, the constitution of the electrophotographic photoreceptor of the invention can be used for a known charging member. For example, the above-mentioned roll charging member, blade charging member, belt charging member, brush charging member, magnet brush charging member and the like are applicable.

The above-mentioned roll charging member, blade charging member and belt charging member are constituted by a material which is adjusted to an effective electrical resistance ($10^3$ to $10^8$ Ω) as the charging member, and may be constituted by a single layer or a plural number of layers. As the material, elastomers consisting of synthetic rubbers such as an urethane rubber, a silicone rubber, a fluorine rubber, a chloroprene rubber, a butadiene rubber, an EPDM and an epichlorohydrine rubber; a polyolefin, a polystyrene, a poly (vinyl chloride) and the like are main materials, and can be used by compounding the appropriate amount of an arbitrary conductivity donating agent such as a conductive carbon, a metal oxide or an ion conductive agent to express the effective electrical resistance as the charging member. Further, it can be used by making the coating of resins such as a nylon, a polyester, a polystyrene, a polyurethane and a silicone resin, compounding the appropriate amount of the arbitrary conductivity donating agent such as a conductive carbon, a metal oxide or an ion conductive agent, and laminating the obtained coating on the above-mentioned conductive layer surface by an arbitrary method such as dipping, spray or role coating.

The roll charging member, blade charging member and belt charging member which are thus obtained are impregnated with the fluororesin-containing treatment solution by known methods to prepare the charge member which is the objective of the invention.

Further, with respect to the above-mentioned brush charging member, fibers in which conductivity is bestowed to a conventionally used acryl resin, nylon and polyester and the like are preliminarily impregnated with the fluororesin-containing treatment solution, and then hair planting is carried out using known methods to prepare the brush charging member. Further, after the above-mentioned various fibers are formed on the brush charging member, it may be treated with the impregnation with the fluororesin-containing treatment solution.

Further, the brush charging member is not specifically limited to the forms such as those formed in a roll and those in which fiber hair is planted on a flat plate.

Further, the above-mentioned magnet brush charging member is a member obtained by radially arranging ferrite or magnetite and the like having magnetism on the peripheral surface of a cylinder internally storing multi polar magnet. It is preferable to make the magnet brush after preliminarily treating the ferrite or magnetite and the like used, with the fluorine impregnation.

On the other hand, in the invention, known cleaning systems can be used for the electrophotographic photoreceptor, and for example, a blade cleaning system, a scraper cleaning system, a fur brush cleaning system, an electrostatic brush system and the like are applicable. Further, a system using a cleaning blade and a brush cleaner in combination is also applicable. Among these, the cleaning blade system is preferable because it is low cost and the stability of performance is high.

The cleaning member in the invention is cleaning members such as cleaning blades used for the above-mentioned respective systems, a roll and a brush. As the material of the cleaning blade, an urethane rubber, a silicone rubber, a fluorine rubber, a chloroprene, a butadiene rubber and the like can be used. Among these, it is preferable to use a polyurethane elastomer (urethane rubber) because it is superior in the abrasion resistance.

As the polyurethane elastomer, in general, there is used a polyurethane which is synthesized through addition reaction of a polyisocyanate with a polyol and various hydrogen containing compounds. As the polyol component, polyether-base polyols such as polypropylene glycol and polytetramethylene glycol; and polyester-base polyols such as adipate-base polyols, polycaprolactam-base polyols and polycarbonate-base polyols are used; and as the polyisocyanate component, aromatic-base polyisocyanates such as tolylene diisocyanate, 4,4'-diphenylmethane diisocyanate, polymethylenepolyphenyl polyisocyanate and toluidine diisocyanate; and aliphatic-base polyisocyanates such as hexamethylene diisocyanate, isophorone diisocyanate, xylylene diisocyanate and dicyclohexylmethane diisocyanate are used to prepare a polyurethane. A curing agent is added to the polyurethane, the mixture is injected in a fixed mold and cured by crosslinking, and the polyurethane elastomer is produced by ripening at normal temperature. As the above-mentioned curing agent, divalent alcohols such as 1,4-butanediol and poly-valent alcohols which are trivalent or more such as trimethylol propane and pentaerythritol are used in combination.

Further, the polyurethane elastomer is treated with the impregnation with the fluororesin-containing treatment solution by known methods to prepare the cleaning member which is the objective of the invention.

Further, as the physical property of the cleaning blade, for example, there can be used those in which the hardness (JIS A scale) is in the range of 50 to 90°, Young coefficient is in the range of $3.9\times10^6$ to $8.8\times10^6$ Pa, 100% modulus is in the range of $2.0\times10^6$ to $6.4\times10^6$ Pa, 300% modulus is in the range of $6.9\times10^6$ to $1.5\times10^7$ Pa, tensile strength is in the range of $2.4\times10^7$ to $4.9\times10^7$ Pa, elongation is in the range of 290 to 500%, impact resilience is in the range of 30 to 70%, tear strength is in the range of $2.5\times10^6$ to $7.4\times10^6$ Pa, and tension set is 4.0% or less. Further, it is preferable that pressed contact force is in the range of 10 to 60 N/m and abutting set angle is in the range of 17 to 30°.

In these electrophotographic photoreceptors, the third layer may be a substrate itself which constitutes forms such as the above-mentioned roll, brush, film and blade, and may be a layer which is formed on the surface of the substrate. Further, it is preferable that the third layer has a layer which contains a thermoplastic resin and a curable resin as the binder resin (a binder) in accordance with the use as the electrophotographic photoreceptor.

With respect to the thermoplastic material to be used, examples thereof include: polyethylene, polypropylene, polystyrene, polyester, polyurethane, polyamide, polyallylate, polycarbonate, polyimide, polyvinyl chloride, chlorinated polyethylene, ethylene vinyl acetate, poly(ethylene-ethylacrylate), poly(ethylene-methylacrylate), styrene-butadiene resin, Teflon®, silicone resin, polystyrene, polyvinyl toluene, styrene-based copolymer such as styrene-propylene copolymer, styrene-vinyl toluene copolymer, styrene-vinyl naphthalene copolymer and styrene-methyl acrylate copolymer, polymethacrylate, polybutyl methacrylate, polyvinyl acetate, and respective resins such as aliphatic or alicyclic hydrocarbon resin, aromatic petroleum resin, paraffin wax and carnauba wax; as well as modified substances and copolymers thereof.

With respect to the curable resin to be used, examples thereof include: resins such as phenol resin, urea resin, melamine resin, unsaturated polyester, epoxy resin, polyimide resin and polyamideimide resin; and rubber materials such as natural rubber (NR), styrene-butadiene rubber (SBR), polybutadiene rubber (BR), butyl rubber (IIR), chloroprene rubber (CR), nitrile rubber (NBR), ethylene propylenediene rubber (EPDM), ethylene propylene rubber (EPT), chlorosulfonated polymethene (CSM), silicone rubber (Si), fluororubber (FPM), polysulfide rubber (T), urethane rubber (U), acrylic rubber (ACM) and epichlorohydrin rubber (ECO).

The fourth layer externally contacting this third layer is a fluororesin-containing layer, and in the invention, it is preferable that the fluororesin-containing layer is injected into voids (concave portions) in the surface of the above-mentioned third layer and the voids are plugged.

In this manner, since the outermost surface of the electrophotographic member of the invention is not a perfect fluororesin-containing layer but is made of a layer (a quasi layer) having a virtually similar property as the fluororesin-containing layer, it is possible to obtain the high mold-releasing property and sliding property, and since the fluororesin-containing layer exists in the inside of the voids in the third layer with which the fluororesin-containing layer is brought in contact, the fluororesin-containing layer is allowed to still exist even if the outermost surface layer (the fourth layer) has been ground through abrasion; therefore, it is possible to maintain the high mold-releasing property and sliding property for a long time. Further, since the fluororesin-containing layer is inserted into the third layer, it is possible to maintain very high adhesive strength between the third layer and the fluororesin-containing layer (the fourth layer).

Moreover, with respect to the method for forming such a fluororesin-containing layer, although not particularly limited, it is preferable to use the same impregnating process as the formation of the fluororesin in the electrophotographic photoreceptor of the invention so that the heat-impregnating process, vacuum-impregnating process or pressure-impregnating process may be used. With respect to the treatment solutions, treatment conditions, etc. to be used in the impregnating process, the same treatment solutions and treatment conditions as those of the formation method of the fluororesin-containing layer in the electrophotographic photoreceptor of the invention may be used, and the materials constituting the layer with which the fluororesin-containing layer is made in contact and the thickness thereof may be desirably combined in accordance with the electrophotographic member to be obtained.

Process Cartridge

In order to exchange consumable parts in an image forming apparatus if necessary, a process cartridge is designed so that some of constituent parts of the image forming apparatus are assembled into cartridges so as to be easily exchanged. The process cartridges are purchased as parts attached to an image forming apparatus, and also purchased as exchange parts or repairing parts in the form of each single unit.

The process cartridge of the invention is provided with at least one device selected from the group consisting of the above-mentioned electrophotographic photoreceptor of the invention, the charging members and the cleaning members, made of the electrophotographic member of the invention and, has an arrangement that is detachably attached to the image forming apparatus. Not particularly limited, the constituent parts other than the electrophotographic photoreceptor to be assembled into the process cartridge may include any conventionally known devices without causing any problems.

The process cartridge of the invention, which is provided with at least one device selected from the group consisting of the electrophotographic photoreceptor of the invention, the charging member and the cleaning member, made of the electrophotographic member of the invention, has constituent parts that have high mold-releasing property and sliding property, and are allowed to maintain the high mold-releasing property and sliding property for a long time; therefore, it is possible to prolong the service life of the process cartridge and also to achieve a reduction in environmental loads and a great cost reduction.

Image-Forming Apparatus

The image forming apparatus of the invention is an image forming apparatus of an electrophotographic system which is provided with at least one member selected from the group consisting of the electrophotographic photoreceptor of the invention, the charging member, the transferring member, the intermediate transferring member, the conveying member and the cleaning member that are constituted by the electrophotographic members of the invention, as well as the process cartridge of the invention.

As long as the image forming apparatus of the invention is provided with at least one member selected from the group consisting of the electrophotographic photoreceptor of the invention, the electrophotographic member of the invention and the process cartridge of the invention, the other structures thereof are not particularly limited, and conventionally known electrophotographic photoreceptor, charging member, transferring member, intermediate transferring member, the conveying member and cleaning member may be installed therein. Moreover, the image forming apparatus of the invention may be provided with an exposure means such as a laser optical system and a LED array, a developing means for forming an image by using toner and the like, a fixing means for fixing a toner image onto a transferring material, a static-eliminating means for eliminating an electrostatic latent image remaining on the surface of the photoreceptor, if necessary, by using conventionally known structures.

The toner used for the image forming apparatus of the invention is not limited by the production process in particular, and there can be used those which is obtained, for example, by a kneading pulverization method of kneading, pulverizing and sieving the binder resin and colorant, mold-releasing agent and if necessary, charge control agent and the like; a method of changing the form of particles obtained by the kneading pulverization method, by a mechanical impact force or thermal energy; an emulsion polymerization flocculation method of polymerizing the polymerizable monomer of the binder resin, and mixing, coagulating and thermally fusing the dispersion solution obtained, with the colorant, mold-releasing agent and if necessary, charge control agent and the like to obtain the toner; a suspension polymerization method of suspending and polymerizing the solution of the polymerizable monomer for obtaining the binder resin and colorant, mold-releasing agent and if necessary, charge control agent and the like, in an aqueous solution; a dissolving suspension polymerization method of suspending and granulating the solution of the binder resin and colorant, mold-releasing agent and if necessary, charge control agent and the like, in an aqueous solution; and the like. Further, known methods such as a production process of using the toner obtained by the above-mentioned methods as a core, and further adhering and thermally fusing the coagulated particles to obtain a core-shell structure can be used, but the suspension polymerization method, emulsion polymerization flocculation method and dissolving suspension polymerization method which carry out production in an aqueous solution are preferable from the viewpoints of form control and the control of particle size distribution, and the emulsion polymerization flocculation method is preferable in particular.

The toner particles are composed of the binder resin and colorant, mold-releasing agent and the like, and if necessary, silica and the charge control agent may be used. The volume average particle size is preferably in the range of 2 to 12 μm and more preferably in the range of 3 to 9 μm. Further, images having high development, transferring property and high quality can be obtained by using the toner particles in which the average form index of the toner ($ML^2/A$:ML, L is the absolute maximum length of the toner particles, and A indicates respectively the projected area of the toner particles) is in the range of 115 to 140.

As the binder resin, there can be exemplified a homopolymer and a copolymer of styrenes such as styrene and chlorostyrene; monoolefins such as ethylene, propylene, butylene and isoprene; vinyl esters such as vinyl acetate, vinyl propionate, vinyl benzoate and vinyl butylate; α-methylene aliphatic monocarboxylic esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; vinyl ketones such as vinyl methyl ketone, vinyl hexyl ketone and vinyl isopropyl ketone; and the like. In particular, as the typical binder resin, there can be mentioned a polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, a polyethylene and a polypropylene and the like. Further, a polyester, a polyurethane, an epoxy resin, a silicone resin, a polyamide, a modified rosin, a paraffin wax and the like can be mentioned.

Further, as the colorant for the toner, there can be exemplified magnetic powders such as magnetite and ferrite; carbon black, Aniline Blue, Calyl Blue, Chrome Yellow, Ultra Marine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3.

As the mold-releasing agent, there can be exemplified a low molecular weight polyethylene, a low molecular weight polypropylene, Fisher Tropsch wax, montan wax, carnauba wax, rice wax, candelilla wax, as a typical example.

Further, the charge control agent may be added to the toner, if necessary. As the charge control agent, known agents can be used, but an azo-base metal complex, a metal complex of salicylic acid, and a resin type charge control agent containing a polar group can be used. When the toner is produced by a wet process, it is preferable to use a material which is hardly dissolved in water is used from the viewpoints of the control of ion strength and the reduction of waste pollution. The toner in the invention may be either of a magnetic toner internally containing a magnetic material and non magnetic toner which does not contain the magnetic material.

In the toner particles obtained as described above, an inorganic granule and an organic granule can be added as external additives such as lubricating particles, a cleaning aid, a polishing agent and the like.

As the lubricating particles which are added in the toner used in the invention, there can be used solid lubricants such as graphite, molybdenum disulfide, talc, a fatty acid and a metal salt of fatty acid; low molecular weight polyolefins such as a polypropylene, a polyethylene and a polybutene; silicones having a softening point by heating; aliphatic amides such as oleic amide, erucic amide, ricinoleic amide, stearic amide, plant-base waxes such as carnauba wax, rice wax, candelilla wax, Japan wax and jojoba oil; animal-base waxes such as bee wax, mineral oils such as montan wax, ozokerite, ceresin, paraffin wax, microcrystalline wax and Fischer-Tropsch wax, petroleum-base wax; and modified articles thereof. These may be used alone or used in combination. However, the average particle size is preferably in the range of 0.1 to 10 μm, and the particle size may be adjusted by pulverizing the particles having the above-mentioned chemical structure. The addition amount to the toner is preferably in the range of 0.05 to 2.0% by mass, and more preferably in the range of 0.1 to 1.5% by mass.

In the tone used for the invention, inorganic fine particles, organic fine particles, complex fine particles obtained by adhering inorganic fine particles to the organic fine particles, and the like can be added in order to remove the adhered articles and the deteriorated article on the surface of the electrophotographic photoreceptor, but the inorganic fine particles excellent in grinding property are preferable in particular. As the inorganic fine particles, there are preferably used various inorganic oxides such as silica, alumina, titania, zirconia, barium titanate, aluminum titanate, strontium titanate, magnesium titanate, zinc oxide, chromium oxide, cerium oxide, antimony oxide, tungsten oxide, stannic oxide, tellurium oxide, manganese oxide, boron oxide, silicon carbide, titanium carbide, silicon nitride, titanium nitride and boron nitride; nitrides, borides and the like. Further, the above-mentioned inorganic fine particles may be treated with titanium coupling agents such as tetrabutyl titanate, tetraoctyl titanate, isopropyltriisostearoyl titanate, isopropyltridodecylbenzenesulfonyl titanate, and bis(dioctylpyrophosphate)oxyacetate titanate; silane coupling agents such as γ-(2-aminoethyl)aminopropyltrimethoxysilane, γ-(2-aminoethyl)aminopropylmethyldimethoxysilane, γ-methacrlyloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltriethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane, etc. Further, hydrophobing processing is preferably carried out by higher fatty acid metallic salt such as silicone oil, aluminum stearate, zinc stearate, calcium stearate.

As the organic fine particles, there can be mentioned styrene resin particles, styrene-acryl resin particles, polyester resin particles, urethane resin particles and the like. When these particle sizes are too little, they are deficient in grinding capability, and when they are too large, scratches tend to occur on the surface of the electrophotographic photoreceptor. Therefore, those having a mean particle size of the range of 5 to 1000 nm, preferably the range of 5 to 800 nm, and more preferably the range of 5 to 700 nm are used. Further, it is preferable that the sum of the addition amount of the above-mentioned lubricating particles is 0.6% by mass or more.

As the other inorganic oxides which are added to the toner, there are mentioned small diameter inorganic oxides having a primary particle size of 40 nm or less for powder flowability, charge control and the like, and further, larger diameter inorganic oxides for the reduction of adhering force and charge control. Known fine particles can be used for these inorganic oxide fine particles, but silica and titanium oxide are preferably used in combination. Further, dispersibility is enhanced by surface treating the small diameter inorganic particles, and the effect of improving powder flowability is enlarged.

The toner in the invention can be produced by mixing the above-mentioned toner particle and the above-mentioned external additive by a Henschel mixer or a V blender or the like. Further, when the toner particle is produced in a wet process, they can be externally added in a wet process.

Further, when the toner in the invention is used as a color toner, it is preferable to be used by mixing with the carrier, but as the carrier, iron powder, glass beads, ferrite powder, nickel powder or those which are treated with resin coating on the surface thereof are used. Further, the mixing proportion of the carrier and the toner can be appropriately set.

According to the image forming apparatus of the invention having the above-mentioned constitution, since the member provided in it can maintain the high mold-releasing property and sliding property over a long period, the member and further the apparatus come to have a long service life, and it is possible to achieve a reduction in environmental loads and a great cost reduction.

The invention being thus described through preferable embodiments, it will be obvious that the same may be varied in many ways; however, such variations are not to be regarded as a departure from the spirit and scope of the invention.

EXAMPLES

Referring to examples, the following description will discuss the present invention; however, the invention is not intended to be limited by these examples.

Firstly, there are illustrated the toner and developer which are used in the real machine evaluation of the electrophotographic photoreceptor, the electrophotographic member and the like of the under-mentioned Examples.

The values of the respective physical properties are carried out by the methods below in the illustrations below.

Dispersion Particle, Flocculation Particle, Particle Size Distribution of Toner Particle With respect to the particle size of dispersion particle, the number average particle size D50n of the resin fine particle is measured by a laser diffraction type particle size distribution measurement apparatus (LA-700, manufactured by Horiba, Ltd.).

The particle size distribution of the flocculation particle and toner particle is measured with an aperture diameter of 100 μm using a multi-sizer (manufactured by NIKKAKI Co.).

Average form Coefficient $ML^2/A$ of Toner Particle and Flocculation Particle The toner particle or flocculation particle is observed by an optical microscope, and the image is taken into an image analysis apparatus (LUZEX XIII: manufactured by Nireco Corporation) to measure a circle equivalent diameter. Then, the value of average form coefficient $ML^2/L$ is determined from the maximum length and size of the toner particle and flocculation particle in accordance with the under-mentioned formula, with respect to the respective particles.

$$(ML^2/A)=(\text{maximum length})^2\times\pi\times100/[4\times(\text{area})]$$

Production of Toner Particle

Preparation of Respective Dispersion Solutions

Preparation of Dispersion Solution of Resin Fine Particle

A solution which is obtained by mixing 370 parts by mass of styrene, 30 parts by mass of n-butyl acrylate, 8 parts by mass of acrylic acid, 24 parts by mass of dodecane thiol and 4 parts by mass of carbon tetrabromide, and a solution which is obtained by dissolving 6 parts by mass of a nonion surfactant (NONIPOLE 400: manufactured by Sanyo Chemical Industries Ltd.) and 10 parts by mass of an anion surfactant (NEOGEN SC: manufactured by Dai-ichi Kogyo Seiyaku Co., Ltd.) in 550 parts by mass of ion exchange water, are mixed, emulsion polymerization is started in a flask, and 50 parts by mass of ion exchange water in which 4 parts by mass of ammonium persulfate is dissolved is charged to the mix solution while gradually stirring for 10 minutes. After air in the flask is replaced with nitrogen, the mix solution is heated by an oil bath until the temperature of the mix solution became 70° C. while gradually stirring, and emulsion polymerization is continued for 5 hours as it is.

As a result, there is obtained the dispersion solution of resin fine particle in which the resin fine particle having a mean particle size of 150 nm, a glass transition temperature (Tg) of 58° C. and a weight average molecular weight (Mw) of 11500 is dispersed. The concentration of the dispersion solution is 40% by mass.

Preparation of Dispersion Solution of Colorant 1

60 Parts by weight of carbon black (MOGAL L: manufactured by Cabot Corporation), 6 parts by mass of a nonion surfactant (NONIPOLE 400: manufactured by Sanyo Chemical Industries Ltd.) and 240 parts by mass of ion exchange water are mixed and the mixture is stirred for 10 minutes using a homogenizer (ULTRA-TURRAX T50: manufactured by IKA Co.). Then, dispersion treatment is carried out by an ultimizer to prepare the dispersion solution of a colorant 1 in which the colorant (carbon black) having a mean particle size of 250 nm is dispersed.

Preparation of Dispersion Solution of Colorant 2

360 parts by mass of a cyan pigment (B15: manufactured by Dainichiseika Color & Chemicals Mfg Co., Ltd.), 5 parts by mass of a nonion surfactant (NONIPOLE 400: manufactured by Sanyo Chemical Industries Ltd.) and 240 parts by mass of ion exchange water are mixed and the mixture is stirred for 10 minutes using a homogenizer (ULTRATARAX T50: manufactured by IKA Co.). Then, dispersion treatment is carried out by an ultimizer to prepare the dispersion solution of a colorant 2 in which the particle of colorant (cyan pigment) having a mean particle size of 250 nm is dispersed.

Preparation of Dispersion Solution of Colorant 3

60 Parts by weight of a magenta pigment (R122: manufactured by Dainichiseika Color & Chemicals Mfg Co., Ltd.), 5 parts by mass of a nonion surfactant (NONIPOLE 400: manufactured by Sanyo Chemical Industries Ltd.) and 240 parts by mass of ion exchange water are mixed and the mixture is stirred for 10 minutes using a homogenizer (ULTRA-TURRAX T50: manufactured by IKA Co.). Then, dispersion treatment is carried out by an ultimizer to prepare the dispersion solution of a colorant 3 in which the particle of colorant (magenta pigment) having a mean particle size of 250 nm is dispersed.

Preparation of Dispersion Solution of Colorant 4

90 Parts by weight of a yellow pigment (Y180: manufactured by Clariant (Japan) K.K.), 5 parts by mass of a nonion surfactant (NONIPOLE 400: manufactured by Sanyo Chemical Industries Ltd.) and 240 parts by mass of ion exchange water are mixed and the mixture is stirred for 10 minutes using a homogenizer (ULTRA-TURRAX T50: manufactured by IKA Co.). Then, dispersion treatment is carried out by an ultimizer to prepare the dispersion solution of a colorant 4 in which the particle of colorant (yellow pigment) having a mean particle size of 250 nm is dispersed.

Preparation of Dispersion Solution of Mold-Releasing Agent

100 Parts by weight of a paraffin wax (HNPO 190: manufactured by Nippon Seiro Co., Ltd., melting point: 85° C.), 5 parts by mass of a cation surfactant (SANZOLE B50: manufactured by Kao Corporation) and 240 parts by mass of ion exchange water are mixed and the mixture is stirred for 10 minutes in a round flask made of stainless steel using a homogenizer (ULTRA-TURRAX T50: manufactured by IKA Co.). Then, dispersion treatment is carried out by a pressure discharge type homogenizer to prepare the dispersion solution of a mold-releasing agent in which the particle of mold-releasing agent having a mean particle size of 550 nm is dispersed.

Preparation of Toner Particle

Preparation of Toner Particle K1

234 Parts by weight of the above-mentioned dispersion solution of resin fine particle, 30 parts by mass of the dispersion solution of colorant 1, 40 parts by mass of the dispersion solution of a mold-releasing agent, 0.5 part by mass of a poly(aluminum hydroxide) (Paho2S: manufactured by Asada Chemical Co.) and 600 parts by mass of ion exchange water are respectively charged in a round flask made of stainless steel, and the mixture is mixed and dispersed using a homogenizer (ULTRA-TURRAX T50: manufactured by IKA Co.). Then, the mix solution is heated in an oil bath for heating while stirring, and kept at 40° C. for 30 minutes. At this time, it is confirmed that a flocculation particle having a volume average particle size D50v of 4.5 μm is prepared.

Further, when the temperature of the oil bath for heating is raised and the mix solution is kept at 56° C. for one hour, the D50v is 5.3 μm. After 26 parts by mass of the dispersion solution of resin fine particle is additionally added to the dispersion solution containing the flocculation particle, the mixture is kept at 50° C. for 30 minutes using the oil bath for heating. 1N sodium hydroxide is additionally added to the dispersion solution containing the flocculation particle to adjust the pH of the dispersion solution at 7.0, and then the flask is sealed and heated while continuing the stirring using a magnetic seal and kept at 80° C. for 4 hours. Then, the dispersion solution is cooled, and the toner particle which is prepared in the dispersion solution is separated by filtration, rinsed four times with ion exchange water and then dried by freezing to obtain the toner particle K1. The D50v of the toner particle K1 is 5.9 μm, and the average form coefficient $ML^2/L$ is 132.

Preparation of Toner Particle C1

The toner particle C1 is similarly prepared except for using the dispersion solution of a colorant 2 in place of the dispersion solution of a colorant 1, in the preparation of toner particle K1. The D50v of the toner particle C1 obtained is 5.8 μm, and the average form coefficient $ML^2/A$ is 131.

Preparation of Toner Particle M1

The toner particle M1 is similarly prepared except for using the dispersion solution of a colorant 3 in place of the dispersion solution of a colorant 1, in the preparation of toner particle K1. The D50v of the toner particle M1 obtained is 5.5 μm, and the average form coefficient $ML^2/A$ is 135.

Preparation of Toner Particle Y1

The toner particle C1 is similarly prepared except for using the dispersion solution of a colorant 4 in place of the dispersion solution of a colorant 1, in the preparation of toner particle K1. The D50v of the toner particle Y1 obtained is 5.9 μm, and the average form coefficient $ML^2/A$ is 130.

Production of Career

14 Parts by weight of toluene, 2 parts by mass of a styrene-methacrylate copolymer (component ratio: 90/10), and 0.2 part by mass of carbon black (R 330: manufactured by Cabot Corporation) are mixed, the mixture is stirred for 10 minutes by a stirrer, and dispersion treatment is carried out to prepare a coating solution. Then, the coating solution and 100 parts by mass of a ferrite particle (volume average particle size: 50 μm) are charged in a vacuum degassing type kneader, the mixture is stirred at 60° C. for 30 minutes, and it is degassed by reduced pressure and dried while heating to obtain a career. The volume inherent resistance at an applied electric filed of 1000 V/cm of the career is $10^{11}$ Ω·cm.

Preparation of Developer

100 Parts by mass of the above-mentioned respective toner particles K1, C1, M1 and Y1, 1 part by mass of rutile type titanium oxide (particle size: 20 nm, which is treated with n-decyltrimethoxysilane), 2.0 parts by mass of silica (particle size: 40 nm, which is prepared by a gas phase oxidation process and treated with silicone oil), and 1 part by mass of cerium oxide (average particle size is 0.7 μm), and 0.3 parts by mass of higher fatty acid alcohol (a higher fatty acid alcohol having a molecular weight of 700 is pulverized by a jet mill to make a mean particle size of 8.0 μm) are charged in a 5L Henschel mixer, and blended for 15 minutes at a peripheral speed of 30 m/sec. Then, rough particles are removed using a sieve having an aperture of 45 μm to obtain the toner 1 (4 colors of black, cyan, magenta and yellow).

Then, 100 parts by mass of the above-mentioned career and 5 parts by mass of the toner 1 are stirred for 20 minutes at 40 rpm using a V-blender, and the developer 1 (4 colors of black, cyan, magenta and yellow) is obtained by sieving with a sieve having an aperture of 212 μm.

Example 1

Preparation of Electrophotographic Photoreceptor A

To the surface of a cylinder-shaped aluminum base member (conductive support) having an outer diameter of 30 mmϕ that had been subjected to a honing process is applied through an immersion-coating process a solution composed of 10 parts by mass of a zirconium compound (trade name: Orgatics ZC 540 made by Matsumoto Chemical Industry Co., Ltd.), 1 part by mass of silane compound (trade name: A1100, made by Nippon Unicar Company Limited), 40 parts by mass of isopropanol and 20 parts by mass of butanol, and this is heated and dried at 150° C. for 10 minutes to form a base layer having a film thickness of 0.1 μm.

Next, to 100 parts by mass of butyl acetate is added 1 part by mass of chlorogallium phthalocyanine crystal having strong diffraction peaks at Bragg angles of (2θ±0.2°) 7.4°, 16.6°, 25.5° and 28.3° in the X-ray diffraction spectrum as a charge-generating substance together with 1 part by mass of polyvinyl butyral resin (trade name: Slec BM-S, made by Sekisui Chemical Co., Ltd.), and after this had been treated and dispersed by a paint shaker together with glass beads for 1 hour, the resulting coating solution is applied onto the above-mentioned base layer through an immersion coating process, and this is heated and dried at 100° C. for 10 minutes to form a charge-generating layer having a thickness of approximately 0.15 μm.

Next, 2 parts by mass of a benzidine compound having a structure indicated by the under-mentioned formula (4) and 3 parts by mass of a bisphenol (Z) polycarbonate resin (viscosity average molecular weight: $4.4\times10^4$) having a structure indicated by the under-mentioned formula (5) are dissolved in a mix solvent of 15 parts by mass of monochlorobenzene and 15 parts by mass of tetrahydrofuran, the coating solution obtained is coated by immersion on the surface of the above-mentioned charge-generating layer, and the product is dried by heating at 115° C. for one hour to form the charge-transporting layer having a film thickness of 20 μm.

(4)

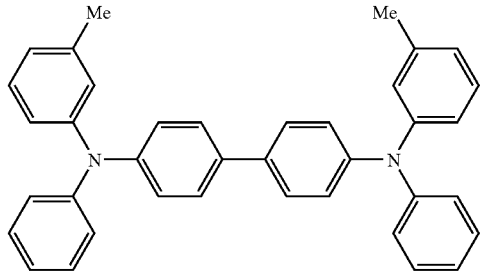

(5)

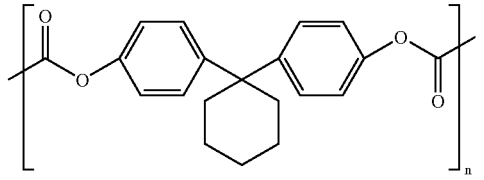

A fluororesin-containing layer is formed on the outer circumferential face of the charge-transporting layer of the laminated member obtained as described above through the following application-impregnating process.

Firstly, the treatment solution A in which the fluororesin having the under-mentioned composition is an essential component is coated by dip coating on the outer peripheral face of the charge-transporting layer of the above-mentioned laminated member. Here, the treatment solution A to be used in this case had a viscosity of 200 mPa·s.

Treatment Solution A

| | |
|---|---|
| Homopolymer of tetrafluoroethylene | 12 parts by mass |
| Copolymer of tetrafluoroethylene | 8 parts by mass |
| Paraffin-based intermediate boiling point solvent | 20 parts by mass |
| Surface active agent, viscosity-increasing agent, stabilizer | 15 parts by mass |
| Water | 45 parts by mass |

Thereafter, the laminated member on which the treatment solution A had been applied is dried in a thermostat chamber at 60° C. for 15 minutes to obtain an electrophotographic photoreceptor of the embodiment 1.

The surface of the electrophotographic photoreceptor A thus obtained is very flat and smooth with high gloss, and no abnormalities such as fogging and cracks are observed. Further, when the existence of fluorine element is confirmed by XPS (X-ray photoelectron spectrophotometer, JPS-80: manufactured by JEOL Ltd.) while etching from the surface of the resultant electrophotographic photoreceptor A by argon gas, the fluororesin-containing layer is confirmed from the outermost layer to a thickness of about 5 μm.

Evaluation

Then, the result of measuring the surface property of the electrophotographic photoreceptor A thus obtained is shown below.

Surface roughness (Rmax): 0.8 μm (measured by a Surfcom made by Tokyo Seimitsu Co., Ltd.)

Water contact angle: 120° (measured by a Contact Angle Meter CA-X made by Kyowa Interface Science Co., Ltd.)

Static frictional force: 0.1 (measured by a Heidon Tribogear Type 941 made by Shinto Scientific Co., Ltd.)

Coefficient of dynamic friction: 0.1 (measured by a Heidon friction coefficient tester)

As described above, extremely good values are obtained as the surface property. Further, it is confirmed that the electrical characteristics of the electrophotographic photoreceptor A change hardly after the formation of the fluororesin-containing layer. Moreover, the coefficient of dynamic friction is 0.8 before the formation of the fluororesin-containing layer of the electrophotographic photoreceptor A; thus, it is confirmed that the sliding property is remarkably improved.

Further, the resulting photoreceptor is attached to a full-color printer (DocuPrint C2220, manufactured by Fuji Xerox Co., Ltd.) in which the above-mentioned toner 1 and the developer 1 are charged in a developing machine, and the revolving torque is measured when a urethane blade is cut into the surface of the photoreceptor with a depth of 1.0 mm. As a result, the revolving torque is 0.078 N·m, which is lowered to ⅛ in comparison with the revolving torque, 0.63 N·m, of the photoreceptor without formation of the fluororesin-containing layer.

Furthermore, the primary transferring efficiency from the electrophotographic photoreceptor A to the intermediate transferring belt is measured. Hereat, the primary transferring efficiency, referred in this case, is indicated by a numeric value obtained by dividing the mass of the toner existing on the surface of the intermediate transferring belt after the primary transferring process, by the mass of the toner existing on the surface of the photoreceptor prior to the primary transferring process.

As a result, the primary transferring efficiency is 99.9% in all the toners of Y (yellow), M (magenta), C (cyan) and K (black). For the purpose of comparison, when the primary transferring efficiency is measured in the same manner by using a photoreceptor without the fluororesin-containing layer, the resulting value is in the range of 93.5 to 96.2% in the respective toners of Y, M, C and K; thus, it is confirmed that the transferring efficiency of the photoreceptor with the fluororesin-containing layer formed thereon is excellent.

Moreover, endurance tests of 50,000 copies are carried out under a high-temperature/high-humidity environment (temperature 28° C., humidity 85% Rh), a low-temperature/low-humidity environment (temperature 10° C., humidity 15% Rh) and a standard environment (temperature 22° C., humidity 55% Rh). Here, the other members and setting conditions of the DocuPrint C2220 are the same as those of a commercially available product except for using the toner 1, the developer 1 and the electrophotographic photoreceptor A of the present embodiment which are manufactured as described above.

As a result, under any of the environments, no problems are raised with respect to images on the initial copies and the 50,000-th copy, and none of abnormalities, such as scratches, pinholes and toner anchoring, are found on the surface of the photoreceptor. In addition, the revolving torque of the photoreceptor after the endurance tests of 50,000 copies is 0.12 N·m, and the water contact angle of the surface of the photoreceptor is 102°, thereby maintaining a superior mold-releasing property.

Example 2

Preparation of Electrophotographic Photoreceptor B

To the surface of a cylinder-shaped aluminum base member (conductive support) having an outer diameter of 84 mmϕ that had been subjected to a honing process is applied through an immersion-coating process a solution composed of 10 parts by mass of a zirconium compound (trade name: Orgatics ZC 540 made by Matsumoto Chemical Industry Co., Ltd.), 1 part by mass of silane compound (trade name: A1100, made by Nippon Unicar Company Limited), 40 parts of isopropanol and 20 parts by mass of butanol, and this is heated and dried at 150° C. for 10 minutes to form a base layer having a film thickness of 0.1 μm.

Next, to 100 parts of butyl acetate is added 1 part by mass of chlorogallium phthalocyanine crystal having strong diffraction peaks at Bragg angles of (2θ±0.2°) 7.4°, 16.6°, 25.5° and 28.3° in the X-ray diffraction spectrum as a charge-generating substance together with 1 part by mass of polyvinyl butyral resin (trade name: Slec BM-S, made by Sekisui Chemical Co., Ltd.), and after this had been treated and dispersed by a paint shaker together with glass beads for 1 hour, the resulting coating solution is applied onto the above-mentioned base layer through an immersion coating process, and this is heated and dried at 100° C. for 10 minutes to form a charge-generating layer having a thickness of approximately. 0.15 μm.

2 parts by mass of a benzidine compound having a structure indicated by the under-mentioned formula (4) and 3 parts by mass of a bisphenol(Z) polycarbonate resin (viscosity average molecular weight: $4.4\times10^4$) having a structure indicated by the under-mentioned formula (5) are dissolved in a mix solvent of 15 parts by mass of monochlorobenzene and 15 parts by mass of tetrahydrofuran, the coating solution obtained is coated by immersion on the surface of the above-mentioned charge-generating layer, and the product is dried by heating at 115° C. for one hour to form the charge-transporting layer having a film thickness of 20 μm.

(4)

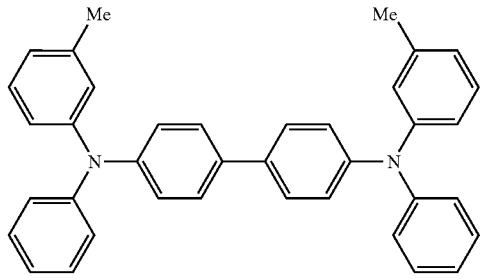

-continued (5)

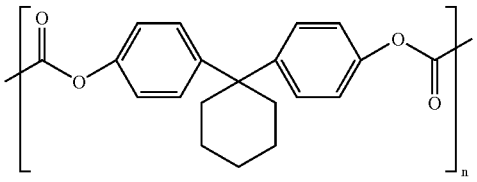

Then, 2 parts by mass of a compound having a structure represented by the under-mentioned formula (6), 2 parts by mass of methyltrimethoxysilane, 0.5 parts by mass of tetramethoxysilane and 0.3 part by mass of colloidal silica are dissolved in a mix solution of 5 parts by mass of isopropyl alcohol, 3 parts by mass of tetrahydrofuran and 0.3 parts by mass of distilled water, 0.5 parts by mass of an ion exchange resin (AMBERLIST 15E) is further added thereto, and hydrolysis is carried out for 24 hours by stirring the mixture at room temperature.

(6)

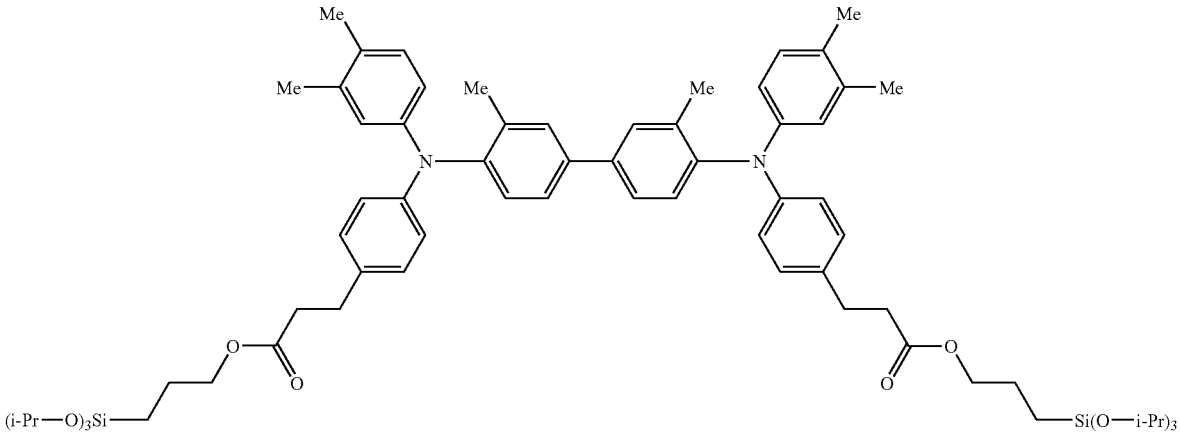

Then, the ion exchange resin is separated by filtration from the reaction mixture after the hydrolysis, and 0.1 parts by mass of aluminum trisacetylacetonate (Al (aqaq)$_3$) and 0.4 part by mass of 3,5-di-tert-butyl-4-hydroxytoluene (BHT) are added to the filtrate to prepare a coating solution for the surface protective layer. The coating solution is coated by a ring type immersion coating method on the surface of the above-mentioned charge-generating layer, the product is dried at room temperature for 30 minutes, then heating treatment is carried out by heating at 170° C. for one hour to form the charge-transporting layer having a film thickness of about 3 μm, and a laminated member having the surface protective layer is obtained.

The fluororesin-containing layer of the treatment solution B using the above-mentioned Example 2 is formed on the outer peripheral face of the surface protective layer of the laminated member which is thus obtained, by carrying out vacuum impregnation treatment.

Firstly, the laminated member is set in a vacuum oven, and pressure is reduced to a vacuum degree of 0.02 MPa while humidifying at 50° C. Next, a treatment solution B containing a fluororesin having the following composition as an essential component is poured into the vacuum oven so that, simultaneously as the treatment solution B is placed on the outer circumferential surface of the surface protective layer, the vacuum oven is quickly returned to normal pressure. After the set of operations including the vacuum state and normal state had been repeated three times, this is dried in a thermostat chamber at 60° C. for 10 minutes to obtain an electrophotographic photoreceptor B. The viscosity of the treatment solution Bused in this case is set to 8 mPa·s.

Treatment Solution B

| | |
|---|---|
| Homopolymer of tetrafluoroethylene | 5 parts by mass |
| Copolymer of tetrafluoroethylene | 5 parts by mass |
| Paraffin-based intermediate boiling point solvent | 20 parts by mass |
| Surface active agent, viscosity-increasing agent, stabilizer | 10 parts by mass |
| Water | 60 parts by mass |

The surface of the electrophotographic photoreceptor B thus obtained is very flat and smooth with high gloss, and no abnormalities such as fogging and cracks are observes. Further, when the existence of fluorine element is confirmed by XPS (X-ray photoelectron spectrophotometer, JPS-80: manufactured by JEOL Ltd.) while etching from the surface of the resulting photoreceptor by argon gas, the fluororesin-containing layer is invaded in a depth of 3 to 5 μm and voids are filled.

Evaluation

The results of the measurements carried out on the surface characteristics of the resulting electrophotographic photoreceptor B are shown below.

Surface roughness (Rmax): 0.8 μm (measured by a Surfcom made by Tokyo Seimitsu Co., Ltd.)

Water contact angle: 110° (measured by a Contact Angle Meter CA-X made by Kyowa Interface Science Co., Ltd.)

Static frictional force: 0.1 (measured by a Heidon Tribogear Type 941 made by Shinto Scientific Co., Ltd.)

Coefficient of dynamic friction: 0.1 (measured by a Heidon friction coefficient tester)

As described above, extremely good values are obtained as the surface property. Further, it is confirmed that the electrical characteristics of the electrophotographic photoreceptor B change hardly after the formation of the fluororesin-containing layer. Moreover, the coefficient of dynamic friction is 1.2 before the formation of the fluororesin-containing layer of the electrophotographic photoreceptor B; thus, it is confirmed that the sliding property is remarkably improved.

Further, the resulting photoreceptor is attached to a full-color copy machine (DocuColor 1255, manufactured by Fuji Xerox Co., Ltd.) in which the above-mentioned toner 1 and the developer 1 are charged in a developing machine, and the revolving torque is measured when a urethane blade is cut into the surface of the photoreceptor with a depth of 1.1 mm. As a result, the revolving torque is 0.11 N·m, which is lowered to ⅛ in comparison with the revolving torque, 0.88 N·m, of the photoreceptor without formation of the fluororesin-containing layer.

Furthermore, the primary transferring efficiency from the electrophotographic photoreceptor B to the intermediate transferring belt is measured in like manner as Example 1.

As a result, the primary transferring efficiency is 99.9% in all the toners of Y (yellow), M (magenta), C (cyan) and K (black). For the purpose of comparison, when the primary transferring efficiency is measured in the same manner by using a photoreceptor without the fluororesin-containing layer, the resulting value is in the range of 92.4 to 95.8% in the respective toners of Y, M, C and K; thus, it is confirmed that the transferring efficiency of the photoreceptor with the fluororesin-containing layer formed thereon is excellent.

Moreover, endurance tests of 100,000 copies are carried out under a high-temperature/high-humidity environment (temperature 28° C., humidity 85% Rh), a low-temperature/low-humidity environment (temperature 10° C., humidity 15% Rh) and a standard environment (temperature 22° C., humidity 55% Rh). Further, the other members and setting conditions of the DocuColor 1255 are the same as those of a commercially available product except for using the toner 1, the developer 1 and the electrophotographic photoreceptor B of the present embodiment which are manufactured as described above.

As a result, under any of the environments, no problems are raised with respect to images on the initial copies and the 100,000-th copy, and none of abnormalities, such as scratches, pinholes and toner anchoring, are found on the surface of the photoreceptor. In addition, the revolving torque of the photoreceptor after the endurance tests of 100,000 copies is 0.18 N·m, and the water contact angle of the surface of the photoreceptor is 98°, thereby maintaining a superior mold-releasing property.

Example 3

Preparation of Cleaning Blade (Cleaning Member)

A urethane material is injected into a mold and heated to form a blade-shaped product having 330 mm in length, 20 mm in width and 2 mm in thickness (JIS A hardness: 75°). A fluororesin-containing layer is formed on the surface of the urethane blade formed in this manner by using a vacuum-impregnating process as described below.

Firstly, the resulting urethane blade is placed in a vacuum oven, and the oven is pressure-reduced to a degree of vacuum of 0.02 MPa while being heated to 50° C. Next, a treatment solution C containing a fluororesin having the following composition as an essential component is poured into the vacuum oven so that, simultaneously as the treatment solution C is placed on the surface of the urethane blade, the vacuum oven is quickly returned to normal pressure. After the set of operations including the vacuum state and normal state had been repeated three times, this is dried in a thermostat chamber at 60° C. for 10 minutes to obtain a cleaning blade. The viscosity of the treatment solution C used in this case is set to 30 mPa·s.

Treatment Solution C

| | |
|---|---|
| Homopolymer of tetrafluoroethylene | 8 parts by mass |
| Copolymer of tetrafluoroethylene | 6 parts by mass |
| Paraffin-based intermediate boiling point solvent | 18 parts by mass |
| Surface active agent, viscosity-increasing agent, stabilizer | 12 parts by mass |
| Water | 56 parts by mass |

The surface of the cleaning blade thus obtained is very flat and smooth with high gloss, and no abnormalities such as fogging and cracks are observed. Moreover, the cross-section of the resulting cleaning blade is observed; thus, it is found that a fluororesin-containing layer being inserted in the urethane layer to a depth of 10 to 30 μm, so as to plug the voids.

Evaluation

The results of the measurements carried out on the surface characteristics of the resulting cleaning blade are shown below.

- Surface roughness (Rmax): 0.9 μm (measured by a Surfcom made by Tokyo Seimitsu Co., Ltd.)
- Water contact angle: 120° (measured by a Contact Angle Meter CA-X made by Kyowa Interface Science Co., Ltd.)
- Static frictional force: 0.1 (measured by a Heidon Tribogear Type 941 made by Shinto Scientific Co., Ltd.)
- Coefficient of dynamic friction: 0.5 (measured by a Heidon friction coefficient tester)

As described above, extremely good values are obtained as the surface property. Further, it is confirmed that the flexibility of the cleaning blade changes hardly before the formation of the fluororesin-containing layer.

Further, the resulting photoreceptor is attached to a full-color copy machine (DocuColor 1255, manufactured by Fuji Xerox Co., Ltd.) in which the above-mentioned toner 1 and the developer 1 are charged in a developing machine, and the revolving torque is measured when a cleaning blade is cut into the surface of the photoreceptor with a depth of 1.1 mm. As a result, the revolving torque is 0.15 N·m, which is lowered to ⅙ in comparison with the revolving torque, 0.88 N·m, of the photoreceptor without formation of the fluororesin-containing layer.

Moreover, endurance tests of 50,000 copies are carried out under a high-temperature/high-humidity environment (temperature 28° C., humidity 85% Rh), a low-temperature/low-humidity environment (temperature 10° C., humidity 15% Rh) and a standard environment (temperature 22° C., humidity 55% Rh). Further, the other members and setting conditions of the DocuColor 1255 are the same as those of a commercially available product except for using the toner 1, the developer 1 and the cleaning blade of the present embodiment which are manufactured as described above.

As a result, under any of the environments, neither peeling of the blade nor the generation of bad cleaning is observed during the endurance tests of 50,000 copies. Moreover, none of abnormalities, such as edge chipping of the cleaning blade, and scratches, pinholes and toner anchoring on the surface of the photoreceptor, are observed. In addition, the revolving torque of the photoreceptor after the endurance tests of 50,000 copies is 0.19 N·m, which is a desirable numeric value.

Example 4

Preparation of Intermediate Transferring Member

Conductive carbon is dispersed in polyimide varnish, and after having been formed into a seamless belt through a centrifugal molding method, this is baked at 340° C. for 60 minutes to obtain a conductive seamless belt having a diameter of 320 mmϕ with a thickness of 80 μm. A fluororesin-containing layer is formed on the surface of the conductive seamless belt thus obtained by using the following vacuum-impregnating process.

The resulting conductive seamless belt is placed in a vacuum oven, and the oven is pressure-reduced to a degree of vacuum of 0.02 MPa while being heated to 50° C. Next, a treatment solution D containing a fluororesin having the following composition as an essential component is poured into the vacuum oven so that, simultaneously as the treatment solution D is placed on the surface of the conductive seamless belt, the vacuum oven is quickly returned to normal pressure. After the set of operations including the vacuum state and normal state had been repeated three times, this is dried in a thermostat chamber at 60° C. for 10 minutes to obtain an intermediate transferring belt (intermediate transferring member) in accordance with the embodiment 4. The viscosity of the treatment solution D used in this case is set to 8 mPa·s.

Treatment Solution D

| | |
|---|---|
| Homopolymer of tetrafluoroethylene | 5 parts by mass |
| Copolymer of tetrafluoroethylene | 5 parts by mass |
| Paraffin-based intermediate boiling point solvent | 20 parts by mass |
| Surface active agent, viscosity-increasing agent, stabilizer | 10 parts by mass |
| Water | 60 parts by mass |

The surface of the intermediate transferring belt thus obtained is very flat and smooth with high gloss, and no abnormalities such as fogging and cracks are observed. Moreover, when the existence of fluorine element is confirmed by XPS (X-ray photoelectron spectrophotometer, JPS-80: manufactured by JEOL Ltd.) while etching from the surface the cross-section of the resulting intermediate transferring belt by argon gas, the fluororesin-containing layer is locally formed in the polyimide layer to a depth of 1 to 3 μm.

The results of the measurements carried out on the surface characteristics of the resulting intermediate transferring belt are shown below.

Surface roughness (Rmax): 1.1 μm (measured by a Surfcom made by Tokyo Seimitsu Co., Ltd.)

Water contact angle: 120° (measured by a Contact Angle Meter CA-X made by Kyowa Interface Science Co., Ltd.)

Static frictional force: 0.1 (measured by a Heidon Tribogear Type 941 made by Shinto Scientific Co., Ltd.)

As described above, extremely good values are obtained as the surface property. Further, it is confirmed that the electrical characteristics of the intermediate transferring belt had virtually no changes before and after the formation of the fluororesin-containing layer.

Further, the resulting intermediate transferring belt is attached to a full-color copying machine (DocuColor 1255: manufactured by Fuji Xerox Co., Ltd.) in which the above-mentioned toner 1 and the developer 1 are charged in a developing machine, and the secondary transferring efficiency from the intermediate transferring belt to a transferring material (paper) is measured. Here, the transferring efficiency, referred in this case, is indicated by a numeric value obtained by dividing the mass of toner existing on the transferring material (paper) after the secondary transferring process by the mass of toner existing on the intermediate transferring belt prior to a secondary transferring process.

As a result, the secondary transferring efficiency is 99.9% in all the toners of Y, M, C and K. For the purpose of comparison, when the secondary transferring efficiency is measured in the same manner by using an intermediate transferring belt without the fluororesin-containing layer, the resulting value is in the range of 84.2 to 90.5% in the respective toners of Y, M, C and K; thus, it is confirmed that the transferring efficiency of the intermediate transferring belt with the fluororesin-containing layer formed thereon is excellent.

Moreover, endurance tests of 100,000 copies are carried out under a high-temperature/high-humidity environment (temperature 28° C., humidity 85% Rh), a low-temperature/low-humidity environment (temperature 10° C., humidity 15% Rh) and a standard environment (temperature 22° C., humidity 55% Rh). Here, the other members and setting conditions of the DocuColor 1255 are the same as those of a commercially available product except for using the toner 1, the developer 1 and the intermediate transferring belt which are manufactured as described above.

As a result, under any of the environments, no problems are raised with respect to images on the initial copies and the 100,000-th copy, and none of abnormalities, such as scratches, pinholes and toner anchoring, are found on the surface of the intermediate transferring belt. In addition, the water contact angle of the surface of the intermediate transferring belt is 99° after the endurance tests of 100,000, thereby maintaining a superior mold-releasing property.

Example 5

Preparation of Charging Roller

A conductive elastic layer is formed on the outer peripheral surface of a shaft having a diameter of 5 mmϕ, a semi-conductive elastic layer is further formed on the outer peripheral surface thereof, and a conductive roller having an outer diameter of 14 mmϕ is prepared. When a voltage of 500 V is applied between the shaft of the conductive roller and the semi-conductive elastic layer, an electric resistance is $5\times10^5$ Ω. A fluororesin-containing layer is formed on the surface of the conductive roller obtained as described above through the following impregnating process.

The resulting conductive roller is immersed in a treatment solution E containing a fluororesin having the following composition as its essential component so that the treatment solution E is applied onto the surface of the conductive roller, and this is heated to 50° C., and left for 30 minutes. Here, the viscosity of the treatment solution E used in this case is set to 3 mPa·s.

Treatment Solution E

| | |
|---|---|
| Homopolymer of tetrafluoroethylene | 4 parts by mass |
| Copolymer of tetrafluoroethylene | 4 parts by mass |

-continued

| | |
|---|---|
| Paraffin-based intermediate boiling point solvent | 10 parts by mass |
| Surface active agent, viscosity-increasing agent, stabilizer | 10 parts by mass |
| Water | 72 parts by mass |

Thereafter, the conductive roller on which the treatment solution E had been applied is taken out, and dried in a thermostat chamber at 60° C. for 10 minutes to obtain a charging roller of the embodiment 5.

The surface of the charging roller thus obtained is very flat and smooth with high gloss, and no abnormalities such as fogging and cracks are observed. Moreover, when the existence of fluorine element is confirmed by XPS (X-ray photoelectron spectrophotometer, JPS-80: manufactured by JEOL Ltd.) while etching from the surface of the charging roller by argon gas, the fluororesin-containing layer is locally invaded in the semi-conductive elastic layer to a depth of 5 to 20 μm.

Evaluation

The results of the measurements carried out on the surface characteristics of the resulting charging roller are shown below.

Surface roughness (Rmax): 1.6 μm (measured by a Surfcom made by Tokyo Seimitsu Co., Ltd.)

Water contact angle: 110° (measured by a Contact Angle Meter CA-X made by Kyowa Interface Science Co., Ltd.)

Static frictional force: 0.2 (measured by a Heidon Tribogear Type 941 made by Shinto Scientific Co., Ltd.)

As described above, extremely good values are obtained as the surface property. Further, it is confirmed that the electrical characteristics of the photoreceptor had virtually no changes before and after the formation of the fluororesin-containing layer.

Further, the resulting charging roller is attached to a full-color printer (DocuPrint C2220, manufactured by Fuji Xerox Co., Ltd.) in which the above-mentioned toner 1 and the developer 1 are charged in a developing machine, and the endurance tests of 50,000 copies are carried out at a high temperature/high humidity environment (temperature: 28° C., humidity: 85% RH), a low temperature/low humidity environment (temperature: 10° C., humidity: 15% RH), and a standard environment (temperature: 22° C., humidity: 55% RH). Further, the other members and setting conditions of the DocuPrint C2220 are the same as those of a commercially available product except for exchanging the toner 1, the developer 1 and the charging roller which are manufactured as described above.

As a result, under any of the environments, no problems are raised with respect to images on the initial copies and the 50,000-th copy, and none of abnormalities, such as scratches, pinholes and toner anchoring, are found on the surface of the charging roller. In addition, the water contact angle of the surface of the photoreceptor is 105° after the endurance tests of 50,000 copies, thereby maintaining a superior mold-releasing property.

Example 6

Preparation of Secondary Transferring Roller (Transferring Member)

A conductive foamed layer is formed on the outer peripheral surface of a shaft having an outer diameter of 14 mmϕ, a semi-conductive solid layer is further formed on the outer peripheral surface thereof, and a conductive roller having an outer diameter of 28 mmϕ is prepared. When a voltage of 1000 V is applied between the shaft of the conductive roller and the semi-conductive solid layer, an electric resistance is $5\times10^7$ Ω. A fluororesin-containing layer is formed on the surface of the conductive roller obtained as described above through the following impregnating process.

The resulting conductive roller is immersed in a treatment solution F containing a fluororesin having the following composition as its essential component so that the treatment solution F is applied onto the surface of the conductive roller, and this is heated to 60° C., and left for 30 minutes. Here, the viscosity of the treatment solution F used in this case is set to 200 mPa·s.

Treatment Solution F

| | |
|---|---|
| Homopolymer of tetrafluoroethylene | 12 parts by mass |
| Copolymer of tetrafluoroethylene | 8 parts by mass |
| Paraffin-based intermediate boiling point solvent | 20 parts by mass |
| Surface active agent, viscosity-increasing agent, stabilizer | 15 parts by mass |
| Water | 45 parts by mass |

Thereafter, the conductive roller on which the treatment solution F had been applied is taken out, and dried in a thermostat chamber at 65° C. for 10 minutes to obtain a secondary charging roller.

The surface of the secondary transferring roller thus obtained is extremely flat and smooth with high gloss, and no abnormalities such as fogging and cracks are observed at all. Further, when the existence of fluorine element is confirmed by XPS (X-ray photoelectron spectrophotometer, JPS-80: manufactured by JEOL Ltd.) while etching from the surface of the resulting secondary transferring roll by argon gas, the fluororesin-containing layer is invaded to a depth of 10 to 30 μm and voids are filled.

The results of the measurements carried out on the surface characteristics of the resulting secondary transferring roller are shown below.

Surface roughness (Rmax): 0.8 μm (measured by a Surfcom made by Tokyo Seimitsu Co., Ltd.)

Water contact angle: 120° (measured by a Contact Angle Meter CA-X made by Kyowa Interface Science Co., Ltd.)

Static frictional force: 0.2 (measured by a Heidon Tribogear Type 941 made by Shinto Scientific Co., Ltd.)

As described above, extremely good values are obtained as the surface property. Further, it is confirmed that the electrical characteristics of the secondary transferring roller had virtually no changes before and after the formation of the fluororesin-containing layer.

Further, the resulting secondary transferring roller is attached to a full-color printer (DocuPrint C2220, manufactured by Fuji Xerox Co., Ltd.) in which the above-mentioned toner 1 and the developer 1 are charged in a developing machine, and the endurance tests of 100,000 copies are carried out at a high temperature/high humidity environment (temperature: 28° C., humidity: 85% RH), a low temperature/low humidity environment (temperature: 10° C., humidity: 15% RH), and a standard environment (temperature: 22° C., humidity: 55% RH). Further, the other members and setting conditions of the DocuPrint C2220 are the same as those of a commercially available product except for exchanging the toner 1, the developer 1 and the secondary transferring roller which are manufactured as described above.

As a result, under any of the environments, no problems are raised with respect to images on the initial copies and the 100,000-th copy, and hardly any of abnormalities, such as defectives and stains, are found on the surface of the secondary transferring roller. Moreover, the water contact angle of the surface of the secondary transferring roller is 101° after the endurance tests of 100,000 copies, thereby maintaining a superior mold-releasing property.

Example 7

The electrophotographic photoreceptor A manufactured in Example 1, the cleaning blade manufactured in Example 3 and the charging roller manufactured in Example 5 are assembled into a monochrome printer (DocuPrint 280 made by Fuji Xerox Co., Ltd.) as a process cartridge, and the endurance tests of 50,000 copies are carried out under a high temperature/high humidity environment (temperature 28° C., humidity 85% RH), a low temperature/low humidity environment (temperature 10° C., humidity 15% RH) and a standard environment (temperature 22° C., humidity 55% RH). Here, except for the exchange of the process cartridge of the photoreceptor, the cleaning blade and the charging roller, the other members and setting conditions of the DocuPrint 280 are the same as those of a commercially available product.

As a result, under any of the environments, no problems are raised with respect to images on the initial copies and the 50,000-th copy, and none of abnormalities, such as scratches, pinholes and toner anchoring, are found on the surface of the photoreceptor. Moreover, no abnormalities are observed on the cleaning blade and the charging roller. In addition, the revolving torque of the photoreceptor after the endurance tests of 50,000 copies is 0.11 N·m; and the water contact angle of the photoreceptor is 105°, the water contact angle of the cleaning blade is 102° and the water contact angle of the charging roller is 107°, thereby maintaining a superior mold-releasing property in each of the members.

Example 8

Preparation of Electrophotographic Photoreceptor C

A laminated member having the surface protective layer is obtained in like manner as Example 2 except that those until the charge-transporting layer are formed using the compound having the structure indicated by the under-mentioned formula (7) in place of the compound having the structure indicated by the formula (4), and then the surface protective layer having a film thickness of about 2 μm is formed using the compound having the structure indicated by the under-mentioned formula (8) in place of the compound having the structure indicated by the formula (6) in the preparation of electrophotographic photoreceptor B.

(7)

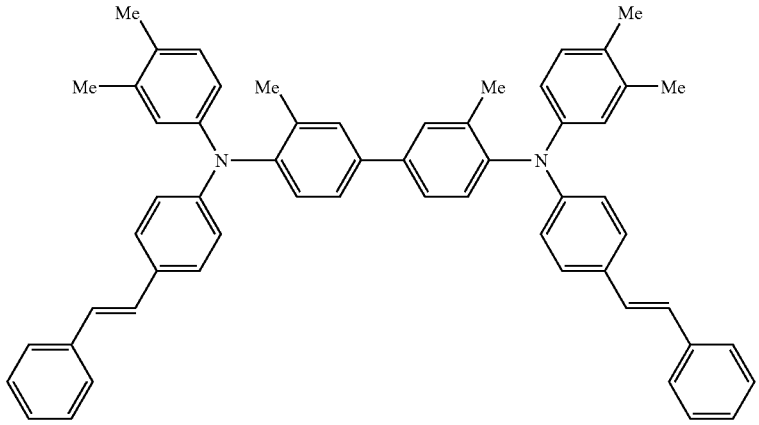

(8)

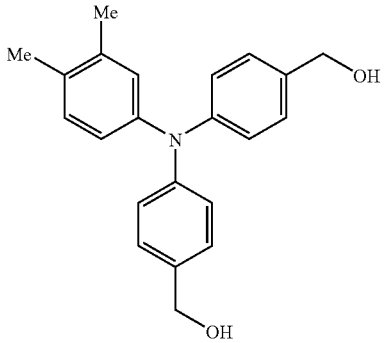

The fluororesin-containing layer is formed on the outer peripheral face of the surface protective layer of the laminated member which is thus obtained, by carrying out vacuum and pressured impregnation treatments which are shown below.

Firstly, the resulting laminated member is set in a vacuum oven, and pressure is reduced to a vacuum degree of 0.02 MPa at room temperature for 30 minutes. Then, a treatment solution containing a fluororesin having the following composition as an essential component is poured into a vacuum oven so that, simultaneously as the treatment solution B is placed on the outer peripheral surface of the surface protective layer, the vacuum oven is quickly returned to normal pressure. Successively, it is pressured to 0.2 MPa and this condition is maintained for 30 minutes. After returning the pressure to normal pressure, it is adequately rinsed with water, and dried at 50° C. for 30 minutes to obtain an electrophotographic photoreceptor C.

The surface of the electrophotographic photoreceptor C thus obtained is extremely smooth and glorious, and abnormalities such as fading and cracking are not observed at all. Further, when the existence of fluorine element is confirmed by XPS (X-ray photoelectron spectrophotometer, JPS-80: manufactured by JEOL Ltd.) while etching from the surface of the resulting photoreceptor by argon gas, the fluororesin-containing layer is invaded in a depth of 3 to 5 μm and voids are filled.

Evaluation

Then, the results of measuring the surface properties of the electrophotographic photoreceptor C are shown below.

Surface roughness (Rmax): 0.7 μm (measured by a Surfcom made by Tokyo Seimitsu Co., Ltd.)

Water contact angle: 112° (measured by a Contact Angle Meter CA-X made by Kyowa Interface Science Co., Ltd.)

Static frictional force: 0.1 (measured by a Heidon Tribogear Type 941, manufactured by Shinto Scientific Co., Ltd.)

Coefficient of dynamic friction: 0.1 (measured by a Heidon friction coefficient tester)

As described above, extremely good values are obtained as the surface property. Further, it is confirmed that the electrical characteristics of the electrophotographic photoreceptor C change hardly after the formation of the fluororesin-containing layer. Moreover, the coefficient of dynamic friction is 1.1 before the formation of the fluororesin-containing layer of the electrophotographic photoreceptor B; thus, it is confirmed that the sliding property is remarkably improved.

Further, the resulting photoreceptor is attached to a full-color copy machine (DocuColor 1255, manufactured by Fuji Xerox Co., Ltd.) in which the above-mentioned toner 1 and the developer 1 are charged in a developing machine, and the revolving torque is measured when a urethane blade is cut into the surface of the photoreceptor with a depth of 1.1 mm. As a result, the revolving torque is 0.11 N·m, which is lowered to ⅛ in comparison with the revolving torque, 0.88 N·m, of the photoreceptor without formation of the fluororesin-containing layer.

Further, the primary transferring efficiency from the electrophotographic photoreceptor c to the intermediate transferring belt is measured in like manner as Example 1.

As a result, the primary transferring efficiency is 99.9% in all the toners of Y (yellow), M (magenta), C (cyan) and K (black). As the comparison, when the primary transferring efficiency is measured in similar manner by using a photoreceptor which does not form the fluororesin-containing layer, the resulting value is in the range of 92.7 to 96.1% in the respective toners of Y, M, C and K; thus, it is confirmed that the transferring efficiency of the photoreceptor which formed the fluororesin-containing layer is extremely good.

Moreover, endurance tests of 100,000 copies are carried out under a high temperature/high humidity environment (temperature: 28° C., humidity: 85% RH), a low-temperature/low humidity environment (temperature: 10° C., humidity: 15% RH) and a standard environment (temperature: 22° C., humidity: 55% RH) Further, the other members and setting conditions of the DocuColor 1255 are the same as those of a commercially available product except for using the toner 1, the developer 1 and the electrophotographic photoreceptor C of the present Example which are manufactured as described above.

As a result, under any of the environments, no problems are raised with respect to images on the initial copies and the $100{,}000^{th}$ copy, and none of abnormalities such as scratches, pinholes and toner anchoring are found at all on the surface of the photoreceptor. Additionally, the revolving torque of the photoreceptor after the endurance tests of 100,000 copies is 0.13 N·m, and the water contact angle of the surface of the photoreceptor is 98°, thereby maintaining a superior mold-releasing property.

In accordance with the invention, it becomes possible to provide an electrophotographic photoreceptor and an electrophotographic member which have superior mold-releasing property and sliding property, and also maintains the superior mold-releasing property and sliding property for a long time. Moreover, by installing the above-mentioned electrophotographic photoreceptor and electrophotographic member, it is also possible to provide a process cartridge and an image forming apparatus which can reduce environmental loads, and also cut costs to a great degree.

What is claimed is:

1. An electrophotographic photoreceptor comprising at least:

a first layer having voids in a surface of the first layer; and a second layer containing fluororesin comprising at least one of a homopolymer and a copolymer of tetrafluoroethylene and externally disposed on the surface of the first layer to be an outermost layer, wherein the second layer is formed from a substantially aqueous dispersion of the fluororesin, wherein the second layer inserts into and fills a concave portion of voids in the surface of the first layer.

2. An electrophotographic photoreceptor according to claim 1, wherein the coefficient of dynamic friction of the surface of the second layer is 0.5 or less.

3. An electrophotographic photoreceptor according to claim 1, wherein the first layer comprises a single layer having both a charge-generating function and a charge transferring function.

4. An electrophotographic photoreceptor according to claim 1, wherein the first layer comprises a charge-generating layer having a charge-generating function and a separate charge-transporting layer having a charge-transporting function.

5. An electrophotographic photoreceptor according to claim 1, wherein the first layer includes a layer containing a thermoplastic resin.

6. An electrophotographic photoreceptor according to claim 1, wherein the first layer includes a layer containing a curable resin.

7. An electrophotographic photoreceptor according to claim 1, wherein the first layer includes a layer containing Si atom.

8. An electrophotographic photoreceptor according to claim 1, wherein the second layer is formed by an impregnating process in which a substantially aqueous dispersion containing the fluororesin comprising the at least one of a homopolymer and a copolymer of tetrafluoroethylene is used.

9. An electrophotographic photoreceptor according to claim 1, wherein the second layer is formed by an application-impregnating process in which a substantially aqueous dispersion containing the fluororesin comprising the at least one of a homopolymer and a copolymer of tetrafluoroethylene is applied to the outer circumferential face of the first layer, and the coated face is left for a predetermined time.

10. An electrophotographic photoreceptor according to claim 1, wherein the second layer is formed by a heat-impregnating process in which a substantially aqueous dispersion containing the fluororesin comprising the at least one of a homopolymer and a copolymer of tetrafluoroethylene is applied to the outer circumferential face of the first layer at a temperature higher than normal temperature.

11. An electrophotographic photoreceptor according to claim 1, wherein the second layer is formed by a vacuum-impregnating process in which a substantially aqueous dispersion containing the fluororesin comprising the at least one of a homopolymer and a copolymer of tetrafluoroethylene is applied to the outer circumferential face of the first layer and the coated face is subjected to a reduced-pressure process and a normal-pressure process repeatedly at a temperature of not less than normal temperature.

12. An electrophotographic photoreceptor according to claim 1, wherein the second layer is formed by a pressure-impregnating process in which a substantially aqueous dispersion containing the fluororesin comprising the at least one of a homopolymer and a copolymer of tetrafluoroethylene is applied to the outer circumferential face of the first layer and the coated face is subjected to a pressure-applying process and a normal-pressure process repeatedly at a temperature of not lower than normal temperature.

13. An electrophoto graphic member comprising at least:

a first layer having voids on a surface of the first layer; and a second layer containing fluororesin comprising at least one of a homopolymer and a copolymer of tetrafluoroethylene and externally disposed on the surface of the first layer to form an outermost layer, wherein the second layer is formed from a substantially aqueous dispersion of the fluororesin, wherein the second layer inserts into and fills a concave portion of voids in the surface of the first layer.

14. An electrophotographic member according to claim 13, wherein the first layer includes a layer containing a thermoplastic resin.

15. An electrophotographic member according to claim 13, wherein the first layer includes a layer containing a curable resin.

16. An electrophotographic member according to claim 13, wherein the second layer is formed by an impregnating process in which a treatment solution containing the fluororesin comprising the at least one of a homopolymer and a copolymer of tetrafluoroethylene is used.

17. An electrophotographic member according to claim 13, wherein the second layer is formed by an application-impregnating process in which a treatment solution containing the fluororesin comprising the at least one of a homopolymer and a copolymer of tetrafluoroethylene is applied to the outer circumferential face of the first layer and the coated face is left for a predetermined time.

18. An electrophoto graphic member according to claim 13, wherein the second layer is formed by a heat-impregnating process in which a treatment solution containing the fluororesin comprising the at least one of a homopolymer and a copolymer of tetrafluoroethylene is applied to the outer circumferential face of the first layer at a temperature higher than normal temperature.

19. An electrophotographic member according to claim 13, wherein the second layer is formed by a vacuum-impregnating process in which a treatment solution containing the fluororesin comprising the at least one of a homopolymer and a copolymer of tetrafluoroethylene is applied to the outer circumferential face of the first layer and the coated face is subjected to a reduced-pressure process and a normal-pressure process repeatedly at a temperature of not less than normal temperature.

20. An electrophotographic member according to claim 13, wherein the second layer is formed by a pressure-impregnating process in which a treatment solution containing the fluororesin comprising the at least one of a homopolymer and a copolymer of tetrafluoro ethylene is applied to the outer circumferential face of the first layer and the coated face is subjected to a pressure-applying process and a normal-pressure process repeatedly at a temperature of not lower than normal temperature.

21. An electrophotographic member according to claim 13, wherein the electrophotographic member serves as cleaning member which is abutted by an electrophotographic photoreceptor, and removes residual toner on the surface of the electrophotographic photoreceptor.

22. An electrophotographic member according to claim 21, wherein the surface of the cleaning member has a coefficient of dynamic friction of not more than 1.0.

23. An electrophotographic member according to claim 13, wherein the electrophotographic member serves as a charging member, which is abutted by an electrophoto graphic sensitive member, and charges the surface of the electrophotographic photoreceptor.

24. An electrophotographic member according to claim 13, wherein the electrophotographic member serves as a transferring member, which is abutted by an electrophotographic sensitive member through a transferring material, and transfers a toner image on the surface of the electrophotographic sensitive member to the transferring material.

25. An electrophotographic member according to claim 13, wherein the electrophotographic member serves as an intermediate transferring member, which is abutted by an electrophotographic photoreceptor, and allows a toner image on the surface of the electrophotographic photoreceptor to be transferred thereon.

26. An electrophoto graphic member according to claim 13, wherein the electrophotographic member serves as a transferring member, which is abutted by an intermediate transferring member, and allows a toner image on an electrophotographic photoreceptor to be transferred onto the intermediate transferring member.

27. An electrophotographic member according to claim 13, wherein the electrophotographic member serves as a transferring member, which is abutted by an intermediate transferring member through a transferring material, and allows a toner image on the surface of the intermediate transferring member to be transferred onto the transferring material.

28. An electrophoto graphic member according to claim 13, wherein the electrophotographic member serves as a conveying member which transports a transferring material.

29. A process cartridge detachably attached to an image forming apparatus, wherein the process cartridge includes:

an electrophotographic photoreceptor including at least a first layer and a second layer containing at least one kind of fluororesin and externally disposed on the first layer, and at least one electrophotographic member including at least a third layer having voids in a surface thereof and a fourth layer containing fluororesin comprising at least one of a homopolymer and a copolymer of tetrafluoroethylene, externally disposed on the surface of the third layer, wherein the fourth layer is formed from a substantially aqueous dispersion of the fluororesin, wherein the fourth layer inserts into and fills a concave portion of voids in the surface of the third layer, wherein the at least one electrophotographic member includes at least one of a cleaning member and a charging member.

30. An image forming apparatus containing a process cartridge detachably attached to an image forming apparatus, the process cartridge comprising:

an electrophotographic photoreceptor including at least a first layer and a second layer containing at least one kind of fluororesin and externally disposed on the first layer, and at least one electrophotographic member including at least a third layer having voids in a surface thereof and a fourth layer containing fluororesin comprising at least one of a homopolymer and a copolymer of tetrafluoroethylene, externally disposed on the surface of the third layer, wherein the fourth layer is formed from a substantially aqueous dispersion of the fluororesin, wherein the fourth layer inserts into and fills a concave portion of voids in the surface of the third layer, wherein the at least one electrophotographic member includes at least one of a cleaning member and a charging member.

31. An image forming apparatus comprising:

an electrophotographic photoreceptor including at least a first layer and a second layer containing at least one kind of fluororesin and externally disposed on the first layer, and at least one electrophotographic member including at least a third layer having voids in a surface thereof and a fourth layer containing fluororesin comprising at least one of a homopolymer and a copolymer of tetrafluoroethylene, externally disposed on the surface of the third layer, wherein the fourth layer is formed from a substantially aqueous dispersion of the fluororesin, wherein the fourth layer inserts into and fills a concave portion of voids in the surface of the third layer, wherein the at least one electrophotographic member includes at least one member selected from a group consisting of a cleaning member, a charging member, a transferring member, an intermediate transferring member and a transporting member.

32. An electrophotographic photoreceptor according to claim 1, wherein the first layer has a charge-generating function and a charge-transporting function.

33. A process cartridge according to claim 29, wherein the first layer has a charge-generating function and a charge-transporting function.

34. An image forming apparatus according to claim 30, wherein the first layer has a charge-generating function and a charge-transporting function.

35. An image forming apparatus according to claim 31, wherein the first layer has a charge-generating function and a charge-transporting function.

36. An image forming apparatus according to claim 35, wherein the first layer comprises a charge-generating layer having the charge-generating function and a separate charge-transporting layer having the charge-transporting function.

37. A process cartridge according to claim 29, wherein the fourth layer is formed by an impregnating process in which a substantially aqueous dispersion containing the fluororesin comprising the at least one of a homopolymer and a copolymer of tetrafluoroethylene is used.

38. An image forming apparatus according to claim 30, wherein the fourth layer is formed by an impregnating process in which a substantially aqueous dispersion containing the fluororesin comprising the at least one of a homopolymer and a copolymer of tetrafluoroethylene is used.

39. An image forming apparatus according to claim 31, wherein the fourth layer is formed by an impregnating process in which a substantially aqueous dispersion containing the fluororesin comprising the at least one of a homopolymer and a copolymer of tetrafluoroethylene is used.

* * * * *